US011331919B2

(12) United States Patent
Kanegae et al.

(10) Patent No.: US 11,331,919 B2
(45) Date of Patent: May 17, 2022

(54) LIQUID DISCHARGING APPARATUS AND SUPPORT BODY

(71) Applicant: SEIKO EPSON CORPORATION, Tokyo (JP)

(72) Inventors: Takahiro Kanegae, Shiojiri (JP); Hiroyuki Hagiwara, Matsumoto (JP); Nobuaki Ito, Shiojiri (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/004,598

(22) Filed: Aug. 27, 2020

(65) Prior Publication Data

US 2021/0060941 A1 Mar. 4, 2021

(30) Foreign Application Priority Data

Aug. 29, 2019 (JP) ..... JP2019-156759

(51) Int. Cl.
*B41J 2/145* (2006.01)
*B41J 2/21* (2006.01)

(52) U.S. Cl.
CPC ..... *B41J 2/145* (2013.01); *B41J 2/2103* (2013.01); *B41J 2202/20* (2013.01)

(58) Field of Classification Search
CPC ..... B41J 2/145; B41J 2/2103; B41J 2202/20
See application file for complete search history.

(56) References Cited

U.S. PATENT DOCUMENTS

2001/0050699 A1* 12/2001 Hickman ..... B41J 2/2132 347/37
2005/0270329 A1* 12/2005 Hoisington ..... B41J 2/2103 347/42
2006/0227157 A1* 10/2006 Drake ..... B41J 29/393 347/13
2008/0100663 A1* 5/2008 Lee ..... B41J 2/155 347/40
2014/0168319 A1* 6/2014 Moreau ..... B41J 2/04505 347/49

FOREIGN PATENT DOCUMENTS

JP 2017-136720 A 8/2017

* cited by examiner

*Primary Examiner* — Justin Seo
(74) *Attorney, Agent, or Firm* — Workman Nydegger

(57) ABSTRACT

The plurality of first nozzles and the plurality of second nozzles are arranged such that a distance between nozzles adjacent to each other in a first direction is a first distance, the support body is provided with a first fixing portion for fixing the first head unit onto the support body and a second fixing portion for fixing the second head unit onto the support body, and a distance between the first fixing portion and the second fixing portion in the first direction is a second distance that is different from an integral multiple of the first distance.

19 Claims, 16 Drawing Sheets

LIQUID DISCHARGING APPARATUS AND SUPPORT BODY

The present application is based on, and claims priority from JP Application Serial Number 2019-156759, filed Aug. 29, 2019, the disclosures of which are hereby incorporated by reference here in their entirety.

BACKGROUND

1. Technical Field

The present disclosure relates to a liquid discharging apparatus and a support body.

2. Related Art

In the related art, a liquid discharging apparatus that discharges a liquid such as ink has been known. For example, JP-A-2017-136720 discloses a liquid discharging apparatus having a plurality of head units provided with nozzles for discharging a liquid.

When the plurality of head units are arranged and used in a direction intersecting an array direction of the nozzles, by arranging the head units so as to be shifted from each other in the arrangement direction, high resolution can be achieved. However, in the related art, there is a problem in that it is difficult to dispose a head unit at an accurate position where the high resolution can be achieved.

SUMMARY

According to an aspect of the present disclosure, there is provided a liquid discharging apparatus including: a first head unit provided with a plurality of first nozzles that discharge a liquid; a second head unit provided with a plurality of second nozzles that discharge the liquid; and a support body supporting the first head unit and the second head unit, in which the plurality of first nozzles and the plurality of second nozzles are arranged such that a distance between nozzles adjacent to each other in a first direction is a first distance, the support body is provided with a first fixing portion for fixing the first head unit onto the support body and a second fixing portion for fixing the second head unit onto the support body, and a distance between the first fixing portion and the second fixing portion in the first direction is a second distance that is different from an integral multiple of the first distance.

According to another aspect of the present disclosure, there is provided a liquid discharging apparatus including: a first head unit provided with a plurality of first nozzles that discharge a liquid; a second head unit provided with a plurality of second nozzles that discharge the liquid; and a support body supporting the first head unit and the second head unit, in which the plurality of first nozzles and the plurality of second nozzles are arranged such that a distance between nozzles adjacent to each other in a first direction is a first distance, the support body is provided with a first fixing portion for fixing the first head unit onto the support body and a second fixing portion for fixing the second head unit onto the support body, and a distance between the first fixing portion and the second fixing portion in the first direction is a second distance that is shorter than the first distance.

According to still another aspect of the present disclosure, there is provided a support body for supporting a first head unit provided with a plurality of first nozzles that discharge a liquid and a second head unit provided with a plurality of second nozzles that discharge the liquid, including: a first fixing portion for fixing the first head unit onto the support body; and a second fixing portion for fixing the second head unit onto the support body, in which a distance between the first fixing portion and the second fixing portion in a first direction is different from an integral multiple of a distance between nozzles adjacent to each other of the plurality of first nozzles and the plurality of second nozzles in the first direction.

DESCRIPTION OF EXEMPLARY EMBODIMENTS

Figure 2:
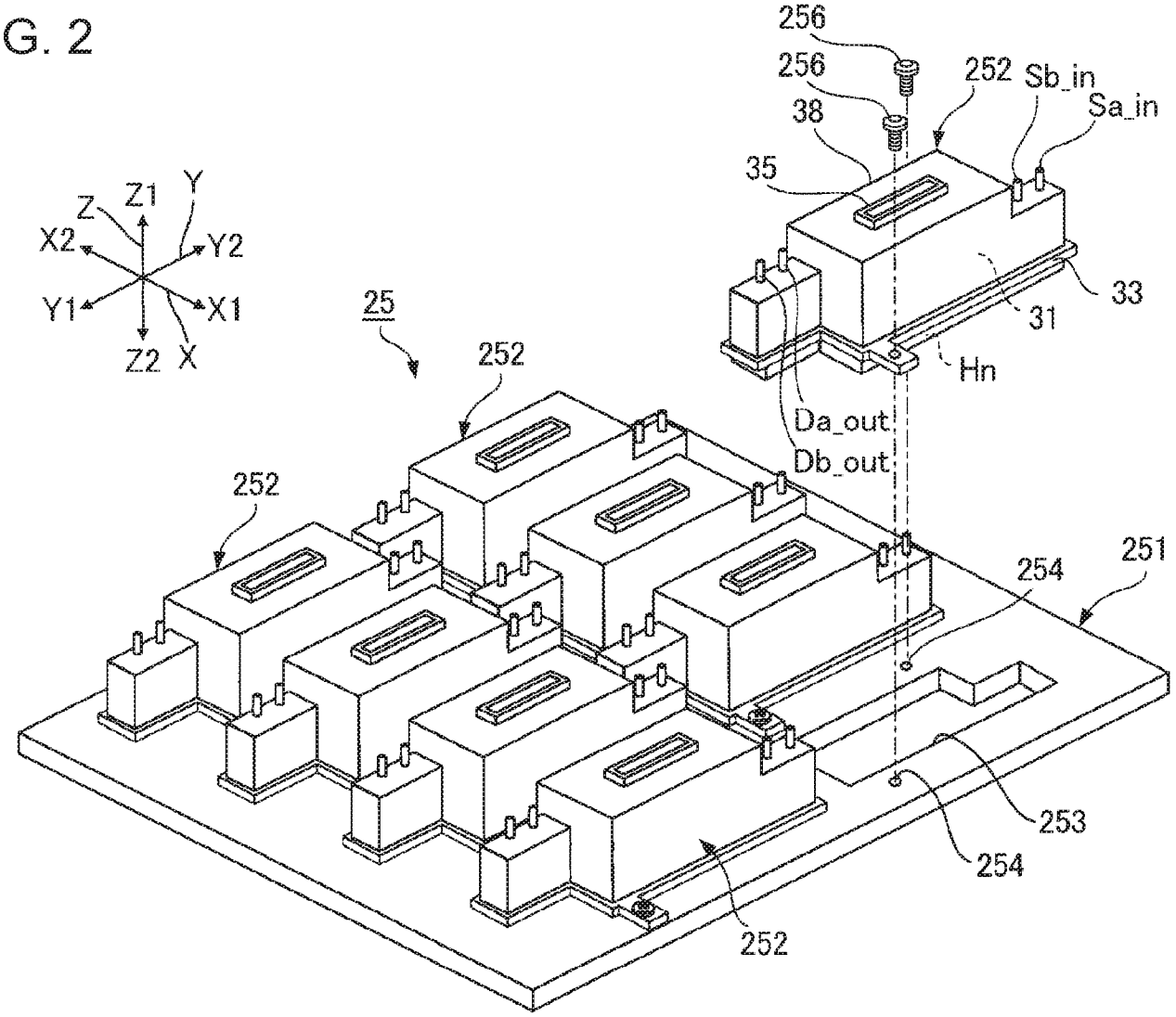
FIG. 2 is a perspective view of a head module.

In the following description, an X axis, a Y axis, and a Z axis that are orthogonal to each other are assumed. As illustrated in FIG. 2, a direction along the X axis when viewed from any point is represented as an X1 direction, and a direction opposite to the X1 direction is represented as an X2 direction. Similarly, directions opposite to each other along the Y axis from any point are represented as Y1 and Y2 directions, and directions opposite to each other along the Z axis from any point are represented as Z1 and Z2 directions. An X-Y plane including the X axis and the Y axis corresponds to a horizontal plane. The Z axis is an axis along the vertical direction, and the Z2 direction corresponds to a lower side in the vertical direction. The X axis, the Y axis, and the Z axis may intersect each other at an angle of approximately 90 degrees.

1. First Embodiment

1-1. Liquid Discharging Apparatus 100

Figure 1:
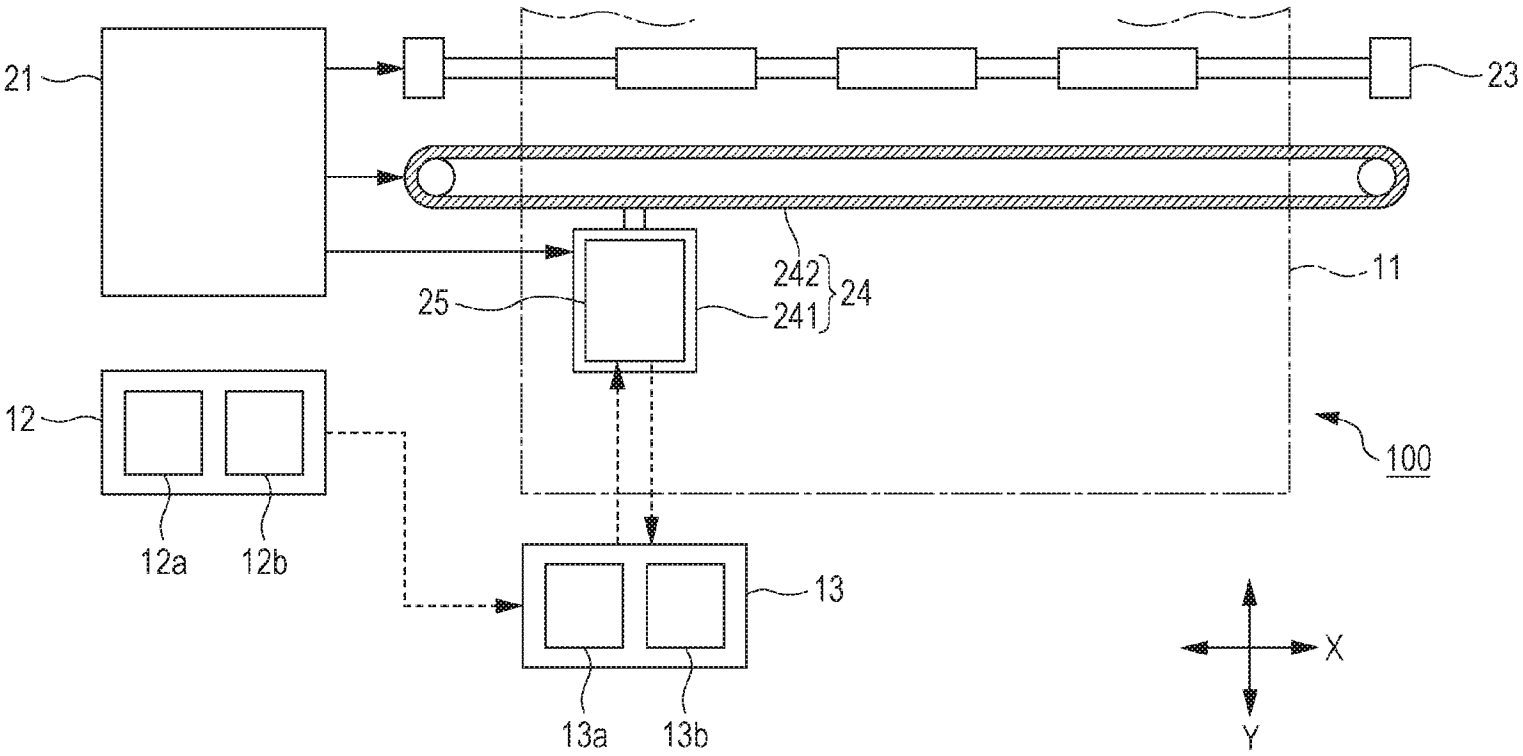
FIG. 1 is a schematic view illustrating a configuration of a liquid discharging apparatus according to a first embodiment.

FIG. 1 is a schematic view illustrating a configuration of a liquid discharging apparatus 100 according to a first embodiment. The liquid discharging apparatus 100 is an ink jet type printing apparatus that discharges ink, which is an example of a liquid, as droplets onto a medium 11. The medium 11 is typically a printing paper. However, a printing target made of any material such as a resin film or cloth may be used as the medium 11, for example.

As illustrated in FIG. 1, the liquid discharging apparatus 100 is provided with a liquid container 12 that stores the ink. For example, a cartridge that is attachable to and detachable from the liquid discharging apparatus 100, a bag-shaped ink pack made of a flexible film, or an ink tank that can be replenished with ink is used as the liquid container 12. As illustrated in FIG. 1, the liquid container 12 includes a liquid container 12*a* and a liquid container 12*b*. A first ink is stored in the liquid container 12*a*, and a second ink is stored in the liquid container 12*b*. The first ink and the second ink are different types of ink. As an example of the first ink and the second ink, there are cases where the first ink is cyan ink and the second ink is magenta ink.

The liquid discharging apparatus 100 is provided with a sub tank 13 that temporarily stores ink. The ink supplied from the liquid container 12 is stored in the sub tank 13. The sub tank 13 includes a sub tank 13*a* that stores the first ink and a sub tank 13*b* that stores the second ink. The sub tank 13*a* is coupled to the liquid container 12*a*, and the sub tank 13*b* is coupled to the liquid container 12*b*. Further, the sub tank 13 is coupled to a head module 25, supplies ink to the head module 25, and collects the ink from the head module 25. The flow of the ink between the sub tank 13 and the head module 25 will be described in detail later.

As illustrated in FIG. 1, the liquid discharging apparatus 100 includes a control unit 21, a transporting mechanism 23, a moving mechanism 24, and the head module 25. The control unit 21 controls each element of the liquid discharging apparatus 100. The control unit 21 includes, for example, one or a plurality of processing circuits such as a central processing unit (CPU) or a field programmable gate array (FPGA), and one or a plurality of storage circuits such as a semiconductor memory.

The transporting mechanism 23 transports a medium 11 along the Y axis under the control of the control unit 21. The moving mechanism 24 causes the head module 25 reciprocates along the X axis under the control of the control unit 21. The moving mechanism 24 according to the present embodiment includes a substantially box-shaped transporting body 241 that accommodates the head module 25, and an endless belt 242 to which the transporting body 241 is fixed. The liquid container 12 and the sub tank 13 may be mounted on the transporting body 241 together with the head module 25.

The head module 25 discharges the ink which is supplied from the sub tank 13, from each of a plurality of nozzles onto the medium 11 under the control of the control unit 21. The head module 25 discharges the ink onto the medium 11 in parallel with the transport of the medium 11 by the transporting mechanism 23 and the repeated reciprocation of the transporting body 241, thereby an image is formed on a surface of the medium 11.

FIG. 2 is a perspective view of the head module 25. As illustrated in FIG. 2, the head module 25 includes a support body 251 and a plurality of head units 252. The support body 251 is a plate-shaped member that supports the plurality of head units 252. A plurality of mounting holes 253 and a plurality of screw holes 254 are formed in the support body 251. Each head unit 252 is supported by the support body 251 in a state inserted into the mounting hole 253. The plurality of screw holes 254 are provided in twos in correspondence with each of the mounting holes 253. As illustrated in FIG. 2, each head unit 252 is fixed to the support body 251 by screwing using screws 256 and screw holes 254 at two places. The plurality of head units 252 are arranged in a matrix-shaped along the X axis and the Y axis. However, the number of head units 252 and the aspect of the arrangement of the plurality of head units 252 are not limited to the above examples.

1-2. Head Unit 252

Figure 3:
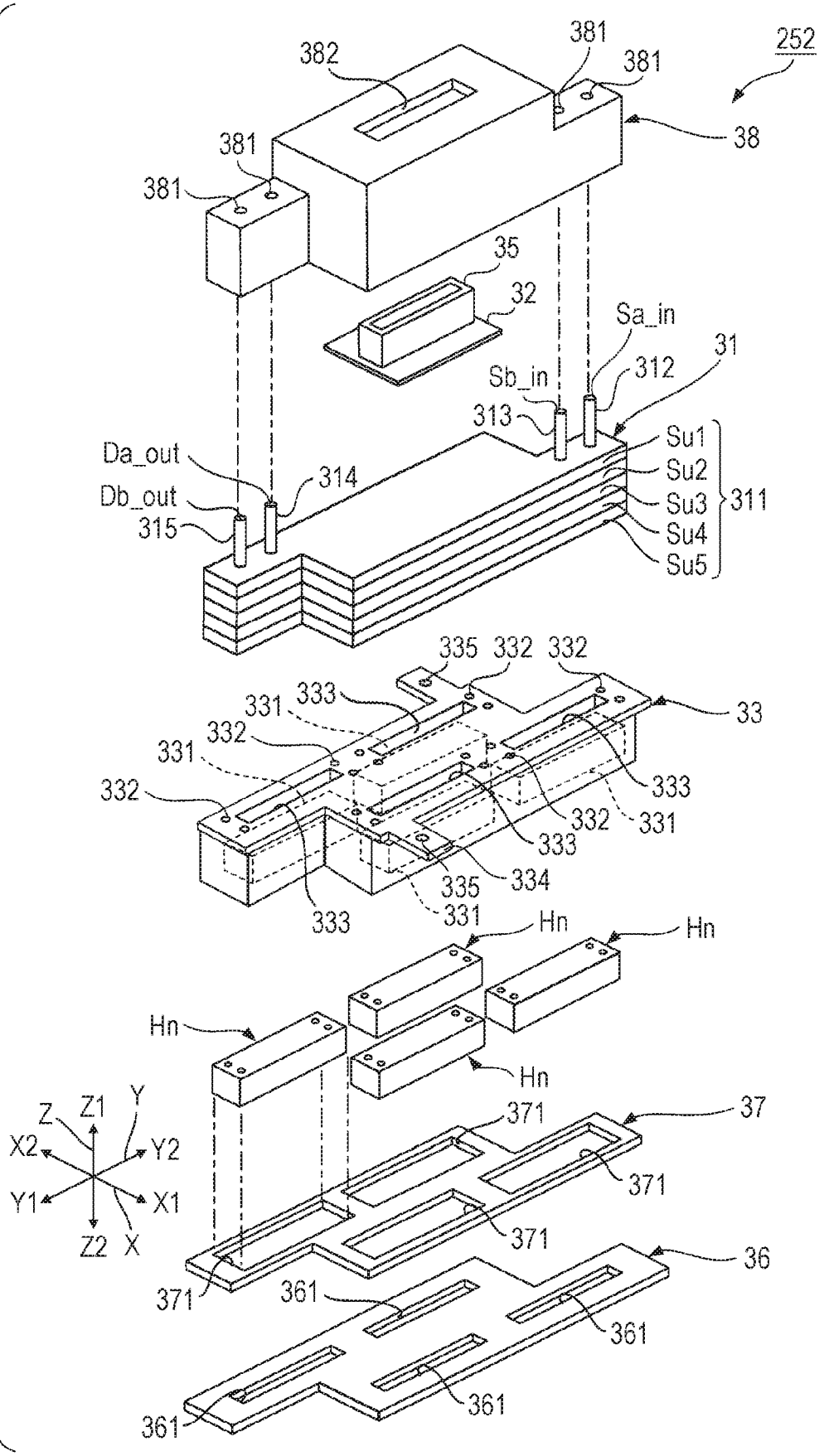
FIG. 3 is a disassembled perspective view of the head unit.

FIG. 3 is a disassembled perspective view of the head unit 252. As illustrated in FIG. 3, the head unit 252 includes a flow path member 31, a wiring substrate 32, a holder 33, a plurality of circulation heads Hn, a fixing plate 36, a reinforcing plate 37, and a cover 38. The flow path member 31 is positioned between the wiring substrate 32 and the holder 33. Specifically, the holder 33 is installed in the Z2 direction with respect to the flow path member 31, and the wiring substrate 32 is installed in the Z1 direction with respect to the flow path member 31. In the present embodiment, the number of circulation heads Hn provided in each head unit 252 is four. In the following, these four circulation heads Hn are also referred to as circulation heads H1, H2, H3, and H4.

The flow path member 31 is a structure having therein a flow path for supplying the ink stored in the sub tank 13 to the plurality of circulation heads Hn. The flow path member 31 includes a flow path structure 311 and coupling pipes 312, 313, 314, and 315. Although not shown in FIG. 3, the flow path structure 311 is provided with a supply flow path for supplying the first ink to the plurality of circulation heads Hn, a supply flow path for supplying the second ink to the plurality of circulation heads Hn, an exhaust flow path for exhausting the first ink from the plurality of circulation heads Hn, and an exhaust flow path for exhausting the second ink from the plurality of circulation heads Hn. The flow path structure 311 is constituted by laminating the plurality of substrates Su1 to Su5. The plurality of substrates Su1 to Su5 constituting the flow path structure 311 are formed by injection molding of a resin material, for example. The plurality of substrates Su1 to Su5 are bonded to each other by, for example, an adhesive. The flow path structure 311 described above has a longitudinal shape along the Y axis. Coupling pipes 312 and 313 are provided in a part at one end of the flow path structure 311 in the longitudinal direction. On the other hand, coupling pipes 314 and 315 are provided in a part at the other end of the flow path structure 311 in the longitudinal direction. Each of the coupling pipes 312, 313, 314, and 315 is a pipe body protruding from the flow path structure 311. The coupling pipe 312 is a supply pipe provided with a supply port Sa_in for supplying the first ink to the flow path structure 311. Similarly, the coupling pipe 313 is a supply pipe provided with a supply port Sb_in for supplying the second ink to the flow path structure 311. On the other hand, the coupling pipe 314 is an exhaust pipe provided with an exhaust port Da_out for exhausting the first ink from the flow path structure 311. Similarly, the coupling pipe 315 is an exhaust pipe provided with an exhaust port Db_out for exhausting the second ink from the flow path structure 311.

The wiring substrate 32 is a mounting component for electrically coupling the head unit 252 to the control unit 21. The wiring substrate 32 is formed of, for example, a flexible wiring substrate, a rigid wiring substrate, or the like. The wiring substrate 32 is disposed on the flow path member 31. One surface of the wiring substrate 32 faces the flow path member 31. A connector 35 is installed on the other surface of the wiring substrate 32. The connector 35 is a coupling component for electrically coupling the head unit 252 and the control unit 21. Further, although not shown, wirings coupled to the plurality of circulation heads Hn are coupled to the wiring substrate 32. The wiring is configured with, for example, a combination of a flexible wiring substrate and a rigid wiring substrate. The wiring may be integrated with the wiring substrate 32.

The holder 33 is a structure that accommodates and supports the plurality of circulation heads Hn. The holder 33 is made of, for example, a resin material or a metal material or the like. The holder 33 is provided with a plurality of recess portions 331, a plurality of ink holes 332, a plurality of wiring holes 333, and a pair of flanges 334. Each of the plurality of recess portions 331 is a space that opens in the Z2 direction and in which the circulation head Hn is disposed. Each of the plurality of ink holes 332 is a flow path through which the ink flows between the circulation head Hn disposed in the recess portion 331 and the flow path member 31 described above. Each of the plurality of wiring holes 333 is a hole through which a wiring (not shown) that couples the circulation head Hn and the wiring substrate 32 is passed. The pair of flanges 334 is fixing portions for fixing the holder 33 to the support body 251. The pair of flanges 334 illustrated in FIG. 3 are provided with holes 335 for screwing to the support body 251. The above-described screw 256 is passed through the hole 335. The hole 335 of a head unit 252_1, which will be described later, corresponds to "a first unit side fixing portion", and the hole 335 of a head unit 252_2 corresponds to "a second unit side fixing portion". The Y axis position of the hole 335 in the head unit 252_1 and the Y axis position of the hole 335 in the head unit 252_2 substantially coincide with each other. The Y axis positions do not necessarily have to coincide with each other, and the interval between these Y axis positions may be p (p is an integer of zero or more) times a distance da described later.

Each circulation head Hn discharges the ink. That is, although not shown in FIG. 3, each circulation head Hn has a plurality of nozzles that discharge the first ink and a plurality of nozzles that discharge the second ink. The configuration of the circulation head Hn will be described later.

The fixing plate 36 is a plate member for fixing the plurality of circulation heads Hn to the holder 33. Specifically, the fixing plate 36 is disposed so as to sandwich the plurality of circulation heads Hn with the holder 33, and is fixed to the holder 33 with an adhesive. The fixing plate 36 is made of, for example, a metal material or the like. The fixing plate 36 is provided with a plurality of opening portions 361 for exposing the nozzles of the plurality of circulation heads Hn. In the example of FIG. 3, the plurality of opening portions 361 are individually provided for each circulation head Hn. The opening portion 361 may be shared by two or more circulation heads Hn.

The reinforcing plate 37 is a plate-shaped member that is disposed between the holder 33 and the fixing plate 36 and reinforces the fixing plate 36. The reinforcing plate 37 is arranged on the fixing plate 36 in an overlapping manner and fixed to the fixing plate 36 with an adhesive. The reinforcing plate 37 is provided with a plurality of opening portions 371 in which the plurality of circulation heads Hn are disposed. The reinforcing plate 37 is made of, for example, a metal material or the like. From the viewpoint of reinforcing the fixing plate 36, the thickness of the reinforcing plate 37 is desirably larger than the thickness of the fixing plate 36.

The cover 38 is a box-shaped member that accommodates the flow path structure 311 of the flow path member 31 and the wiring substrate 32. The cover 38 is made of, for example, a resin material or the like. The cover 38 is provided with four through holes 381 and an opening portion 382. The four through holes 381 correspond to the four coupling pipes 312 of the flow path member 31, and a corresponding coupling pipe 312, 313, 314, or 315 is passed through each through hole 381. The connector 35 is passed through the opening portion 382 from the inside of the cover 38 to the outside.

Figure 4:
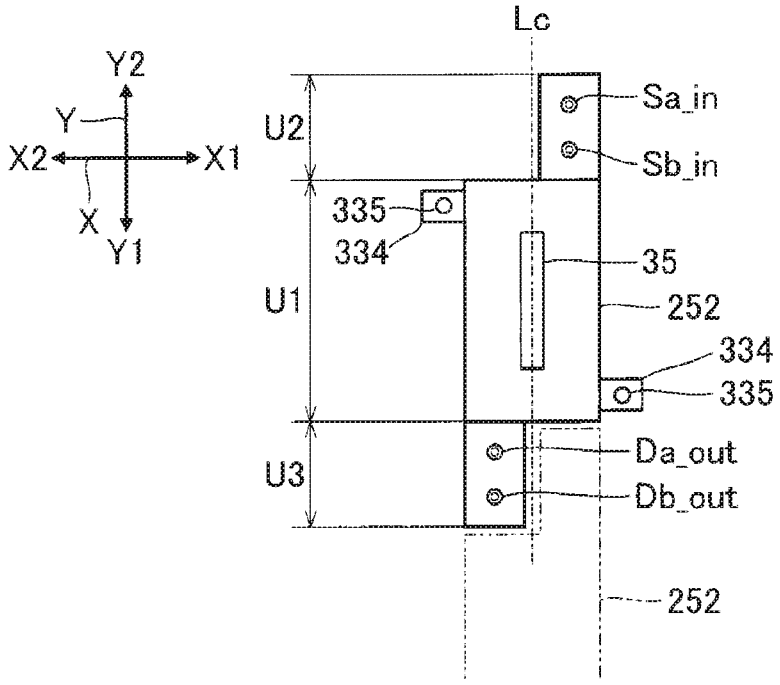
FIG. 4 is a plan view of the head unit as viewed from a Z1 direction.

FIG. 4 is a plan view of the head unit 252 as viewed from the Z1 direction. As illustrated in FIG. 4, each head unit 252 is formed with an outer shape that includes a first part U1, a second part U2, and a third part U3 when viewed from the Z1 direction. The first part U1 is positioned between the second part U2 and the third part U3. Specifically, the second part U2 is positioned in the Y2 direction with respect to the first part U1, and the third part U3 is positioned in the Y1 direction with respect to the first part U1. In the present embodiment, each of the flow path member 31 and the holder 33 is formed with an outer shape corresponding to the head unit 252 when viewed from the Z1 direction. The wiring substrate 32 is formed with an outer shape corresponding to the first part U1 when viewed from the Z1 direction.

In FIG. 4, a center line Lc, which is a line segment passing through a center of the first part U1 along the Y axis, is illustrated. The second part U2 is positioned in the X1 direction with respect to the center line Lc, and the third part U3 is positioned in the X2 direction with respect to the center line Lc. That is, the second part U2 and the third part U3 are positioned on opposite sides of the X axis with the center line Lc interposed therebetween. As illustrated in FIG. 4, the plurality of head units 252 are arranged along the Y axis so that the third part U3 of each head unit 252 and the second part U2 of the other head unit 252 partially overlap each other along the Y axis.

As illustrated in FIG. 4, the pair of flanges 334 are provided on the end surface of the first part U1 in the X1 direction and the end surface of the first part U1 in the X2 direction, respectively. The positions of the pair of flanges 334 are not limited to the positions illustrated in FIG. 4.

Figure 5:
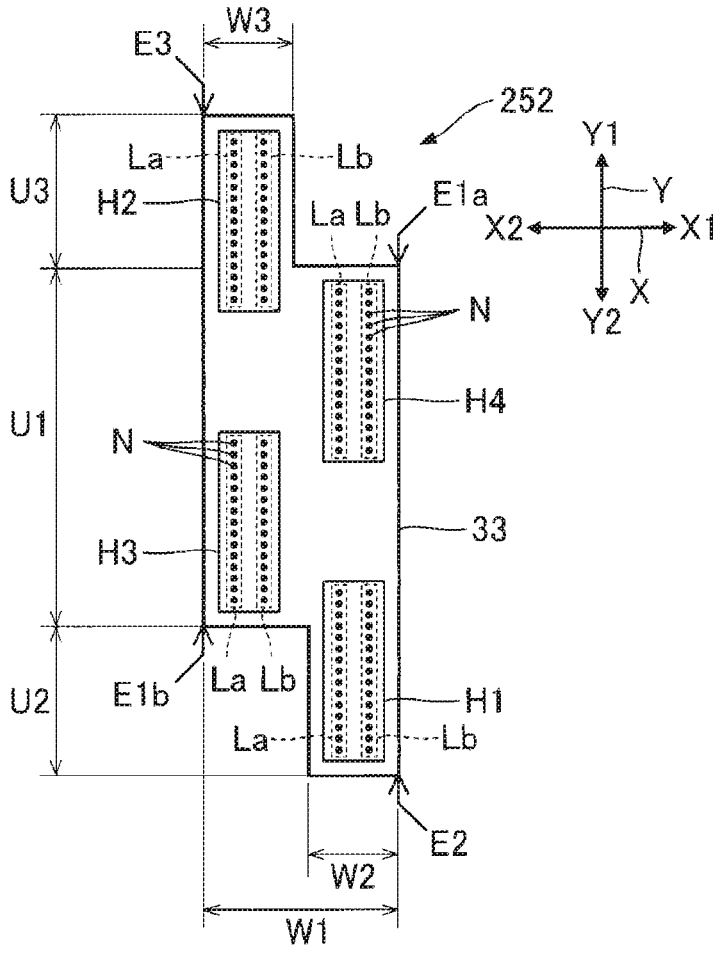
FIG. 5 is a plan view of the head unit as viewed from a Z2 direction.

FIG. 5 is a plan view of the head unit 252 as viewed from the Z2 direction. In FIG. 5, the illustration of the pair of flanges 334 is omitted for convenience of description. As illustrated in FIG. 5, the width W2 of the second part U2 along the X axis is shorter than the width W1 of the first part U1 along the X axis. Similarly, the width W3 of the third part U3 along the X axis is shorter than the width W1 of the first part U1 along the X axis. The width W2 and the width W3 illustrated in FIG. 4 are equal to each other. The width W2 and the width W3 may be different from each other. However, when the width W2 and the width W3 are equal to each other, it is possible to increase the symmetry of the shape of the head unit 252, and as a result, there is an advantage that the plurality of head units 252 can be easily arranged densely. The widths W1, W2, and W3 of the first part U1, the second part U2, and the third part U3 are the widths between one end portion and the other end portion along the X axis of each part.

As illustrated in FIG. 5, since the width W2 and the width W3 are shorter than the width W1, the second part U2 and the third part U3 are protrusions, and the first part U1 can be regarded as the central portion.

An end surface Ela of the first part U1 in the X1 direction is a plane continuous with an end surface E2 of the second part U2 in the X1 direction. On the other hand, an end surface E1*b* of the first part U1 in the X2 direction is a plane continuous with an end surface E3 of the third part U3 in the X2 direction. A recess portion or a projection portion may be appropriately provided on these end surfaces. Further, a step may be provided between the end surface Ela and the end surface E2, and a step may be provided between the end surface E1*b* and the end surface E3.

As illustrated in FIG. 5, the holder 33 of the head unit 252 holds four circulation heads Hn (n=1 to 4). Each circulation head Hn (n=1 to 4) discharges the ink from a plurality of nozzles N. As illustrated in FIG. 5, the plurality of nozzles N are divided into a nozzle row La and a nozzle row Lb. Each of the nozzle row La and the nozzle row Lb is a set of the plurality of nozzles N arranged along the Y axis. The nozzle row La and the nozzle row Lb are provided side by side with an interval in between in the direction of the X axis. In the following description, the subscript a is added to the reference numeral of the element related to the nozzle row La, and the subscript b is added to the reference numeral of the element related to the nozzle row Lb.

1-3. Circulation Head Hn

Figure 6:
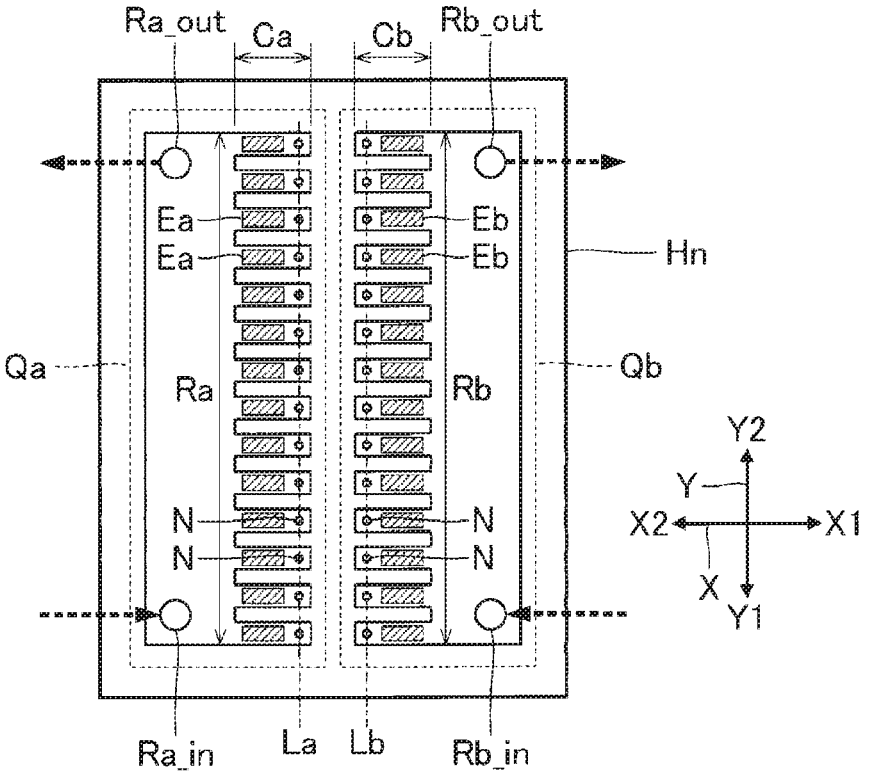
FIG. 6 is a plan view of a circulation head.

FIG. 6 is a plan view of the circulation head Hn. FIG. 6 schematically shows the internal structure of the circulation head Hn viewed from the Z1 direction. As illustrated in FIG. 6, each circulation head Hn includes a liquid discharging portion Qa and a liquid discharging portion Qb. The liquid discharging portion Qa of each circulation head Hn discharges the first ink supplied from the sub tank 13*a* from each nozzle N of the nozzle row La. The liquid discharging portion Qb of each circulation head Hn discharges the second ink supplied from the sub tank 13*b* from each nozzle N of the nozzle row Lb.

The liquid discharging portion Qa includes a liquid storage chamber Ra, a plurality of pressure chambers Ca, and a plurality of driving elements Ea. The liquid storage chamber Ra is a common liquid chamber that is continuous over the plurality of nozzles N of the nozzle row La. The pressure chamber Ca and the driving element Ea are formed for each nozzle N of the nozzle row La. The pressure chamber Ca is a space for communicating with the nozzle N. Each of the plurality of pressure chambers Ca is filled with the first ink supplied from the liquid storage chamber Ra. The driving element Ea changes the pressure of the first ink inside the pressure chamber Ca. For example, a piezoelectric element that changes the volume of the pressure chamber Ca by deforming the wall surface of the pressure chamber Ca or a heat generating element that generates bubbles inside the pressure chamber Ca by heating the first ink inside the pressure chamber Ca is desirably utilized as the driving element Ea. The driving element Ea changes the pressure of the first ink in the pressure chamber Ca, and thus the first ink inside the pressure chamber Ca is discharged from the nozzle N.

The liquid discharging portion Qb includes a liquid storage chamber Rb, a plurality of pressure chambers Cb, and a plurality of driving elements Eb, like the liquid discharging portion Qa. The liquid storage chamber Rb is a common liquid chamber that is continuous over the plurality of nozzles N of the nozzle row Lb. The pressure chamber Cb and the driving element Eb are formed for each nozzle N of the nozzle row Lb. Each of the plurality of pressure chambers Cb is filled with the second ink supplied from the liquid storage chamber Rb. The driving element Eb is, for example, the above-described piezoelectric element or heat generating element. The driving element Eb changes the pressure of the second ink inside the pressure chamber Cb, and thus the second ink inside the pressure chamber Cb is discharged from the nozzle N.

As illustrated in FIG. 6, each circulation head Hn is provided with a supply port Ra_in, an exhaust port Ra_out, a supply port Rb_in, and an exhaust port Rb_out. The supply port Ra_in and the exhaust port Ra_out communicate with the liquid storage chamber Ra. The supply port Rb_in and the exhaust port Rb_out communicate with the liquid storage chamber Rb.

The first ink, among the first ink stored in the liquid storage chamber Ra of each circulation head Hn described above, that is not discharged from each nozzle N of the nozzle row La circulates in the path of the exhaust port Ra_out→the exhaust flow path for the first ink of the flow path member 31→the sub tank 13*a* provided outside the head unit 252→the supply flow path for the first ink of the flow path member 31→the supply port Ra_in →the liquid storage chamber Ra. Similarly, the second ink, among the second ink stored in the liquid storage chamber Rb of each circulation head Hn, that is not discharged from each nozzle N of the nozzle row Lb circulates in the path of the exhaust port Rb_out→the exhaust flow path for the second ink of the flow path member 31→the sub tank 13*b* provided outside the head unit 252→the supply flow path for the second ink of the flow path member 31→the supply port Rb_in →the liquid storage chamber Rb.

1-4. Resolution of Head Unit 252 Alone

Figure 7:
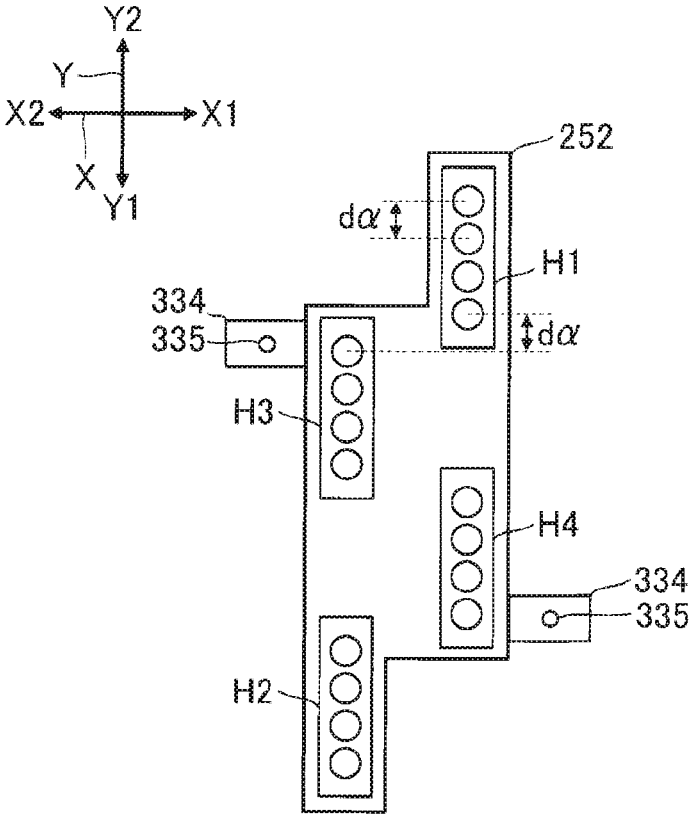
FIG. 7 is a plan view of the head unit.

FIG. 7 is a plan view of the head unit 252. In FIG. 7, a case where the number of nozzles N in the circulation head Hn is four will be described as an example in order to avoid the complication of the drawing. The nozzles N are arranged such that a distance between the nozzles N adjacent to each other in the Y1 direction or the Y2 direction is a distance dα. In the Y1 direction or the Y2 direction, the nozzles N adjacent to each other in the same circulation head Hn are arranged so that the distance between the nozzles is the distance dα, and the nozzles N in a certain circulation head Hn and the nozzles N in another circulation head Hn are arranged so that the distance between the nozzles is also the distance dα. As illustrated in FIG. 7, the distance between the nozzle N provided at the most Y1 direction position in the circulation head H1 and the nozzle N provided at the most Y2 direction position in the circulation head H3 is a distance dα. Similarly, the distance between the nozzle N provided at the most Y1 direction position in the circulation head H3 and the nozzle N provided at the most Y2 direction position in the circulation head H4, and the distance between the nozzle N provided at the most Y1 direction in the circulation head H4 and the nozzle N provided at the most Y2 direction in the circulation head H2 are also the distance dα.

The distance dα includes a case where the distance exactly matches the distance dα and a case where the distance is equal to the distance dα in design but can be considered to be equal to the distance dα in consideration of an error generated due to a manufacturing error of the liquid discharging apparatus 100, for example. The same applies to the description regarding the distance thereafter.

When it is assumed that the unit of the distance dα is inches for simplification of the description, since the distance between the nozzles N is the distance dα, the resolution of the head unit 252 alone is 1/dα [dpi].

1-5. Support Body 251

Figure 8:
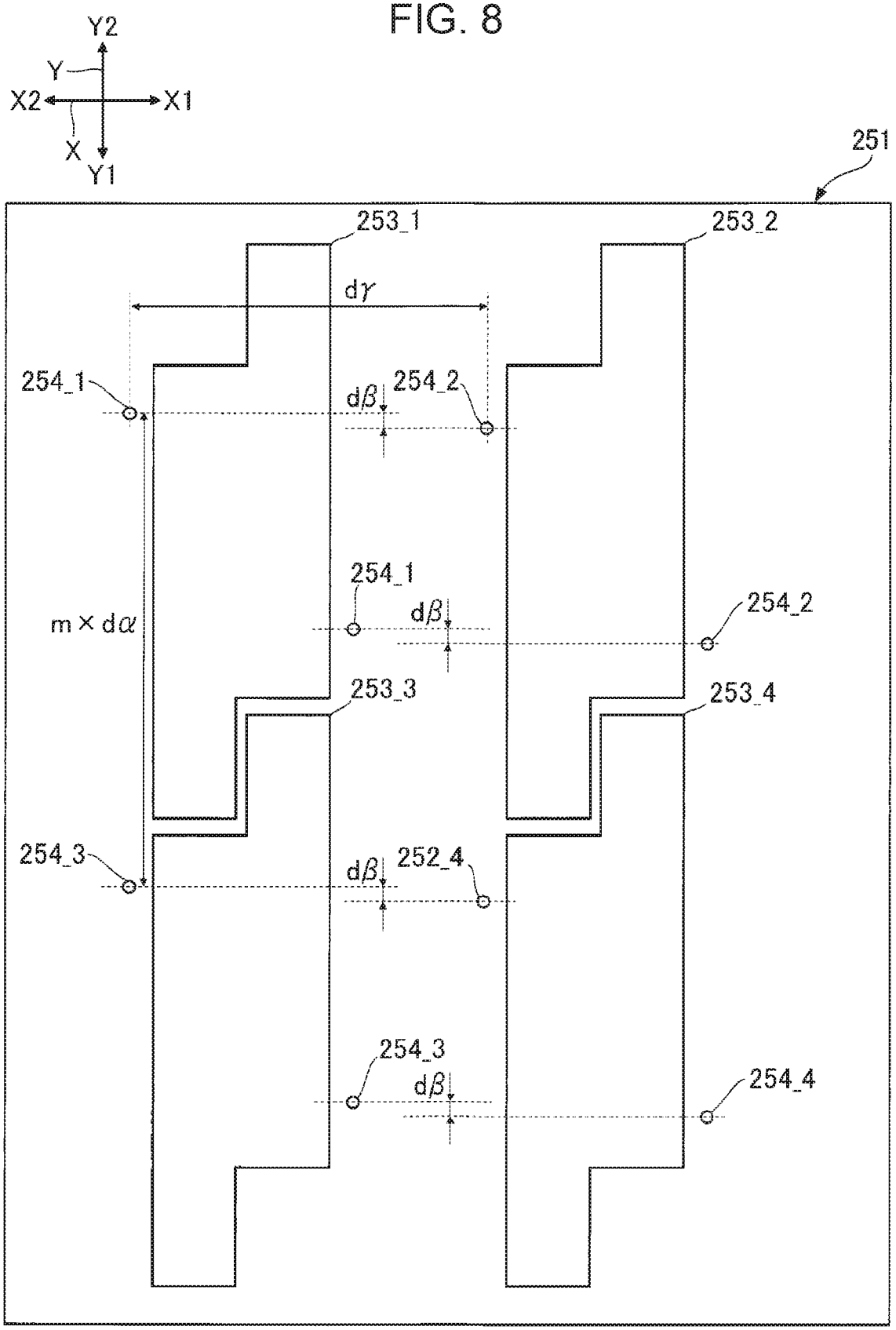
FIG. 8 is a plan view of a support body.

FIG. 8 is a plan view of a support body 251. As illustrated in FIG. 8, a plurality of mounting holes 253 and a plurality of screw holes 254 are formed at the support body 251. Regarding the mounting holes 253, in FIG. 8, a mounting hole 253_1 in which a head unit 252_1 is inserted, a mounting hole 253_2 in which a head unit 252_2 is inserted, a mounting hole 253_3 in which a head unit 252_3 is inserted, and a mounting hole 253_4 in which a head unit 252_4 is inserted are representatively illustrated. Similarly, regarding the screw holes 254, in FIG. 8, a screw hole 254_1 corresponding to the mounting hole 253_1, a screw hole 254_2 corresponding to the mounting hole 253_2, a screw hole 254_3 corresponding to the mounting hole 253_3, and a screw hole 254_4 corresponding to the mounting hole 253_4 are representatively illustrated.

High resolution can be achieved by disposing the head unit 252_2 with respect to the head unit 252_1 by shifting the head in the Y1 direction or the Y2 direction. In the Y1 direction or the Y2 direction, the screw hole 254_2 is formed to be shifted with respect to the screw hole 254_1 by a distance dβ. Similarly, in the Y1 direction or the Y2 direction, the screw hole 254_4 is formed to be shifted with respect to the screw hole 254_3 by a distance dβ. The distance dβ is different from an integral multiple of the distance dα and is desirably shorter than the distance dα. For example, the distance dβ is 0.5 times the distance dα. In the X1 direction or the X2 direction, the screw hole 254_2 is formed to be shifted with respect to the screw hole 254_1 by a distance dγ. The distance dγ is longer than both the distance dα and the distance dβ.

Regarding the distance between the head units 252, in the Y1 direction or the Y2 direction, the distance of the screw hole 254_3 with respect to the screw hole 254_1 is m×distance dα. m is a natural number. In the present embodiment, m is the number of nozzles provided at different positions on the Y axis in one head unit 252. That is, m=16. In this way, it is possible to make the Y axis intervals of dots which are formed by being discharged from each nozzle provided in the head unit 252_1 and the head unit 252_3, substantially equal to dα. In other words, the resolutions of the dots which are formed by being discharged from each nozzle provided in the head unit 252_1 and the head unit 252_3, can be made uniform.

1-6. Disposition of Head Unit 252

Figure 9:
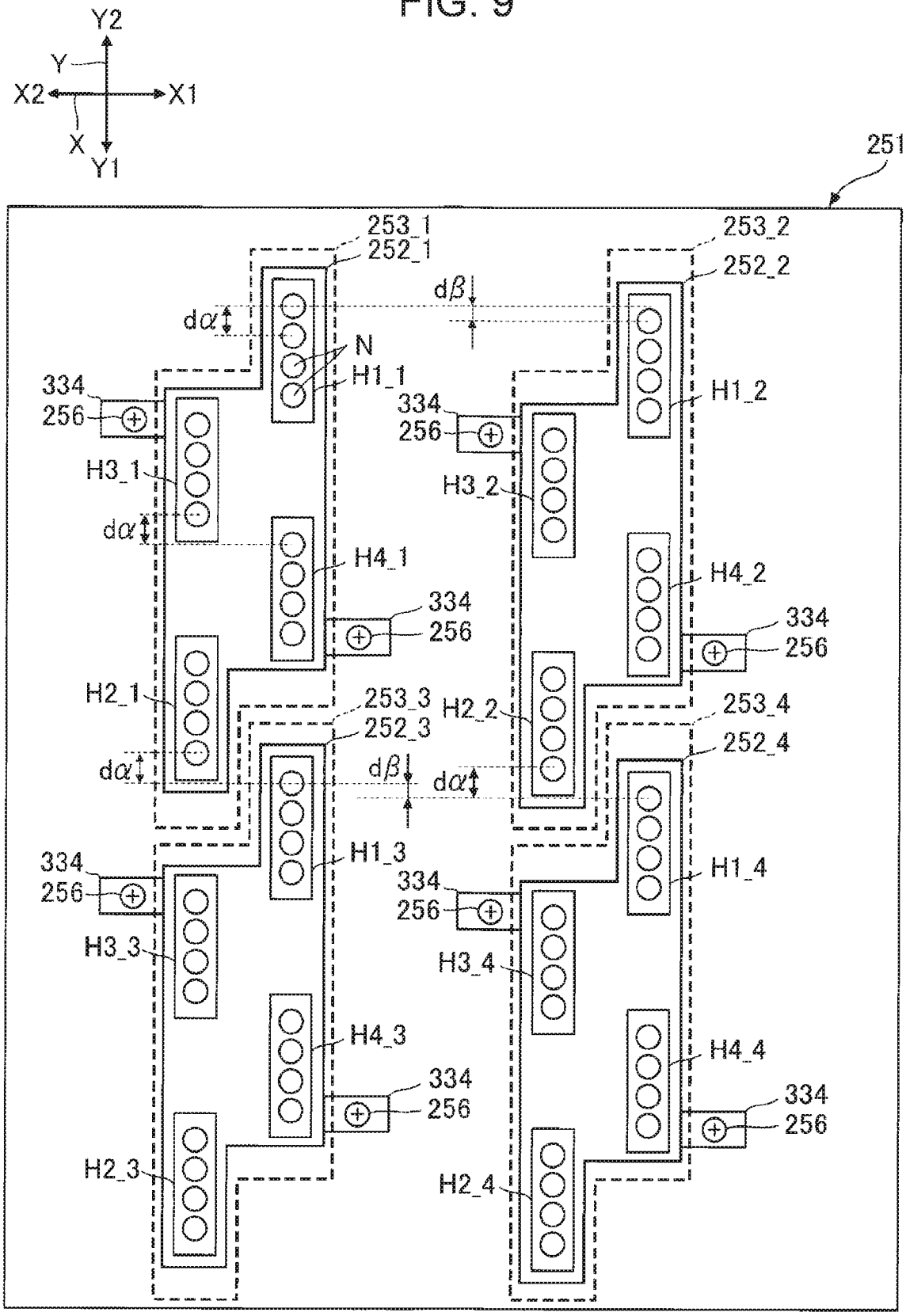
FIG. 9 is a diagram illustrating a state of a support body after fixing the head unit.

FIG. 9 is a diagram illustrating a state of a support body 251 after fixing the head unit 252. In the following description, the circulation heads Hn included in the head unit 252_*i* is also referred to as circulation heads H1_*i*, H2_*i*, H3_*i*, and H4_*i*. i is one of 1, 2, 3, and 4. In the following description, the circulation head H1_*x* included in the head unit 252_*x* may be collectively referred to as "circulation head H1". The circulation head H2, the circulation head H3, and the circulation head H4 are similar to the circulation head H1.

Similarly, the mounting holes 253_*i* into which the head units 252_*i* are inserted may be collectively referred to as "mounting hole 253". Further, the screw holes 254_*i* corresponding to the mounting holes 253_*i* may be collectively referred to as "screw hole 254". Further, the holders 33 that accommodate and support the circulation heads Hn_i may be referred to as "holder 33_*i*".

In the Y1 direction or the Y2 direction, the distance between the head units 252 having the same position in the X1 direction or the X2 direction is the distance dα. For example, the distance between the nozzle N provided at the most Y1 direction position in the circulation head H2_1 and the nozzle N provided at the most Y2 direction position in the circulation head H1_3 is a distance dα. Similarly, the distance between the nozzle N provided at the most Y1 direction in the circulation head H2_2 and the nozzle N provided at the most Y2 direction in the circulation head H1_4 is a distance dα.

In the Y1 direction or the Y2 direction, the screw hole 254_2 is formed to be shifted with respect to the screw hole 254_1 by a distance dβ, and thus the head unit 252_2 is fixed to be shifted with respect to the head unit 252_1 by a distance dβ. As a result, in the Y1 direction or the Y2 direction, the distance between the nozzle N provided in the head unit 252_1 and the nozzle N provided in the head unit 252_2 becomes the distance dβ.

1-7. Effects of First Embodiment

As can be understood from the above, the liquid discharging apparatus 100 has head units 252_1 and 252_2 provided with a plurality of nozzles N that discharge ink, which is an example of a liquid, and a support body 251 that supports the head units 252_1 and 252_2. The head unit 252_1 corresponds to "a first head unit", and the head unit 252_2 corresponds to "a second head unit". The plurality of nozzles N included in the head unit 252_1 correspond to "a plurality of first nozzles". The plurality of nozzles N included in the head unit 252_2 correspond to "a plurality of second nozzles".

The plurality of nozzles N included in the head unit 252_1 and the plurality of nozzles N included in the head unit 252_2 are arranged such that the distance between the nozzles N adjacent with each other in the Y1 direction or the Y2 direction is the distance dα.

The Y1 direction or the Y2 direction corresponds to "a first direction". The distance dα corresponds to a "first distance".

The support body 251 is provided with a screw hole 254_1 for fixing the head unit 252_1 on the support body 251 and a screw hole 254_2 for fixing the head unit 252_2 on the support body 251.

The screw hole 254_1 corresponds to "a first fixing portion". The screw hole 254_2 corresponds to "a second fixing portion".

The distance between the screw hole 254_1 and the screw hole 254_2 in the Y1 direction or the Y2 direction is a distance dβ that is different from an integral multiple of the distance dα.

The distance dβ corresponds to a "second distance".

According to the above configuration, by disposing the head units 252_1 and 252_2 according to the screw holes 254_1 and 254_2 in which the distances are shifted from each other by the distance dβ, the head unit 252 can be easily disposed at an accurate position where the high resolution can be achieved. When the screw holes 254_1 and 254_2 in which the distances shifted from each other by the distance dβ are not provided, a user must shift the distance dβ to fix the head units 252_1 and 252_2 to the support body 251 and it is extremely difficult to dispose the head units 252 in the correct positions. Further, a specialized operator can go to the factory and fix the head units 252_1 and 252_2 to the support body 251, so that the head units 252 can be disposed at the accurate positions, but it is necessary for the operator to go to the factory each time it is fixed, thereby convenience is reduced.

The distance dβ may be different from an integral multiple of the distance dα, but actually it is desirable that dβ=(n1+½)×dα (n1 is an integer of zero or more). When the above expression is satisfied, the nozzle of the head unit 252_2 is positioned exactly in the middle of two adjacent nozzles of the head unit 252_1. Therefore, the intervals of the dots which are formed by being discharged from the head unit 252_1 and the head unit 252_2 in the Y axis, are made uniform in dα×½. In other words, the resolution of the head unit 252_1 and the head unit 252_2 is twice the resolution of the head unit 252 alone.

When dβ≠(n1+½)×dα, the nozzle of the head unit 252_2 is positioned between two adjacent nozzles of the head unit 252_1, but the distance to one nozzle of the head unit 252_1 differs from the distance to the other nozzle. Therefore, the resolution can be improved, but the dot intervals cannot be made uniform to a certain value, so the image quality will be slightly deteriorated as compared with a case where dβ=(n1+½)×dα.

Further, the distance dβ is desirably shorter than the distance dα. When the distance dβ is shorter than the distance dα, in other words, when n1 described above is 0, the length of the head units 252 in the Y1 direction or the Y2 direction when the plurality of head units 252 are fixed to the support body 251 can be the shortest, and the liquid discharging apparatus 100 can be downsized.

Further, the head units 252_1 and 252_2 are provided at different positions on the support body 251 in the X1 direction or the X2 direction, and the distance between the screw hole 254_1 and the screw hole 254_2 in the X1 direction or the X2 direction is a distance dγ which is longer than both the distance dα and the distance dβ. By disposing the head units 252 at different positions on the support body 251 in the X1 direction or the X2 direction, the head units 252 can be disposed along the X axis.

However, the X1 direction or the X2 direction is a direction intersecting the Y1 direction or the Y2 direction, and corresponds to "a second direction". The distance dγ corresponds to a "third distance".

Further, the liquid discharging apparatus 100 further includes a head unit 252_3 provided with a plurality of nozzles that discharge a liquid. The head unit 252_3 corresponds to a "third head unit". The plurality of nozzles N included in the head unit 252_3 correspond to "a plurality of third nozzles".

The support body 251 is further provided with a screw hole 254_3 for fixing the head unit 252_3 on the support body 251. The screw hole 254_3 corresponds to a "third fixing portion".

On the support body 251, the head unit 252_1 and the head unit 252_3 are at different positions in the Y1 direction or the Y2 direction, and provided at the same position in the X1 direction or the X2 direction. As illustrated in FIG. 8, the distance between the screw hole 254_1 and the screw hole 254_3 in the Y1 direction or the Y2 direction is m×distance dα, in other words, an integral multiple of the distance dα. As described above, m=16 in the present embodiment.

The head unit 252_1 further includes a circulation head Hn_1 and a holder 33_1 in which the circulation head Hn_1 is disposed, and the head unit 252_2 further includes a circulation head Hn_2 and a holder 33_2 in which the circulation head Hn_2 is disposed. The circulation head Hn_1 corresponds to "a first head in which a part of a plurality of first nozzles are arranged". The holder 33_1 corresponds to "a first holder". The circulation head Hn_2 corresponds to "a second head in which a part of a plurality of second nozzles are arranged". The holder 33_2 corresponds to "a second holder". In the first embodiment, the head unit 252 has four circulation heads Hn, but the number of circulation heads Hn may be one or plural. When the head unit 252_1 has one circulation head H, the circulation head H corresponds to "a first head in which all of a plurality of first nozzles are arranged". Similarly, when the head unit 252_2 has one circulation head H, the circulation head H corresponds to "a second head in which all of a plurality of second nozzles are arranged".

The holder 33_1 is provided with a hole 335_1 to be fixed to the screw hole 254_1, and the holder 33_2 is provided with a hole 335_2 to be fixed to the screw hole 254_2. By fixing the screw hole 254_1 and the hole 335_1 and fixing the screw hole 254_2 and the hole 335_2, the head units 252_1 and 252_2 are integrated by the support body 251. The hole 335_1 corresponds to "a first fixed portion", and the hole 335_2 corresponds to "a second fixed portion".

Further, as described above, each of the holes 335_1 and the holes 335_2 is a hole portion. The head unit 252 can be fixed to the support body 251 by inserting the screw 256 into the hole 335. However, the head unit 252 may be fixed by means other than the holes. For example, the holder 33 may be provided with a recess portion instead of the hole 335.

The support body 251 is provided with a mounting hole 253_1 that is corresponding to the circulation head Hn_1 when the head unit 252_1 is fixed, and a mounting hole 253_2 that is corresponding to the circulation head Hn_2 when the head unit 252_2 is fixed. The mounting hole 253_1 and the mounting hole 253_2 are provided at the same position in the Y1 direction or the Y2 direction. Providing the mounting hole 253_1 and the mounting hole 253_2 at the same position in the Y1 direction or the Y2 direction is easier to manufacture as compared with a case where the mounting hole 253_1 and the mounting hole 253_2 are provided to be shifted from each other by a distance dβ. Further, by providing the mounting holes 253 at even intervals, the strength can be increased as compared with the case where the mounting holes 253 are provided at uneven intervals. However, the mounting hole 253_1 and the mounting hole 253_2 may be provided so as to be shifted by the distance dβ in the Y1 direction or the Y2 direction.

The mounting hole 253_1 corresponds to "a first opening portion", and the mounting hole 253_2 corresponds to "a second opening portion".

As illustrated in FIG. 8, the support body 251 is provided with a plurality of screw holes 254_1 and a plurality of screw holes 254_2. The plurality of screw holes 254_1 are provided so as to interpose the mounting hole 253_1, and the plurality of screw holes 254_2 are provided so as to interpose the mounting hole 253_2. By providing the plurality of screw holes 254 so as to interpose the mounting holes 253, the head units 252 can be securely fixed as compared with the case where the plurality of screw holes 254 are provided so as not to interpose the mounting holes 253.

The plurality of screw holes 254_1 correspond to "a plurality of first fixing portions", and the plurality of screw holes 254_2 correspond to "a plurality of second fixing portions".

2. Second Embodiment

In the first embodiment, the head unit 252_2 is disposed to be shifted with respect to the head unit 252_1 by the distance dβ in the Y1 direction or the Y2 direction. On the other hand, in a second embodiment, in the Y1 direction or the Y2 direction, it is different from the first embodiment in that it is possible to select that the head unit 252_2 is disposed to be shifted with respect to the head unit 252_1 by the distance dβ or the head unit 252_2 is disposed to be shifted with respect to the head unit 252_1 by the distance dα. Hereinafter, the second embodiment will be described. In each embodiment and each modification example illustrated below, elements having the same operations and functions as those in the first embodiment are assigned the reference numerals used in the first embodiment, and the detailed description of each is appropriately omitted.

2-1. Support Body 251 in Second Embodiment

Figure 10:
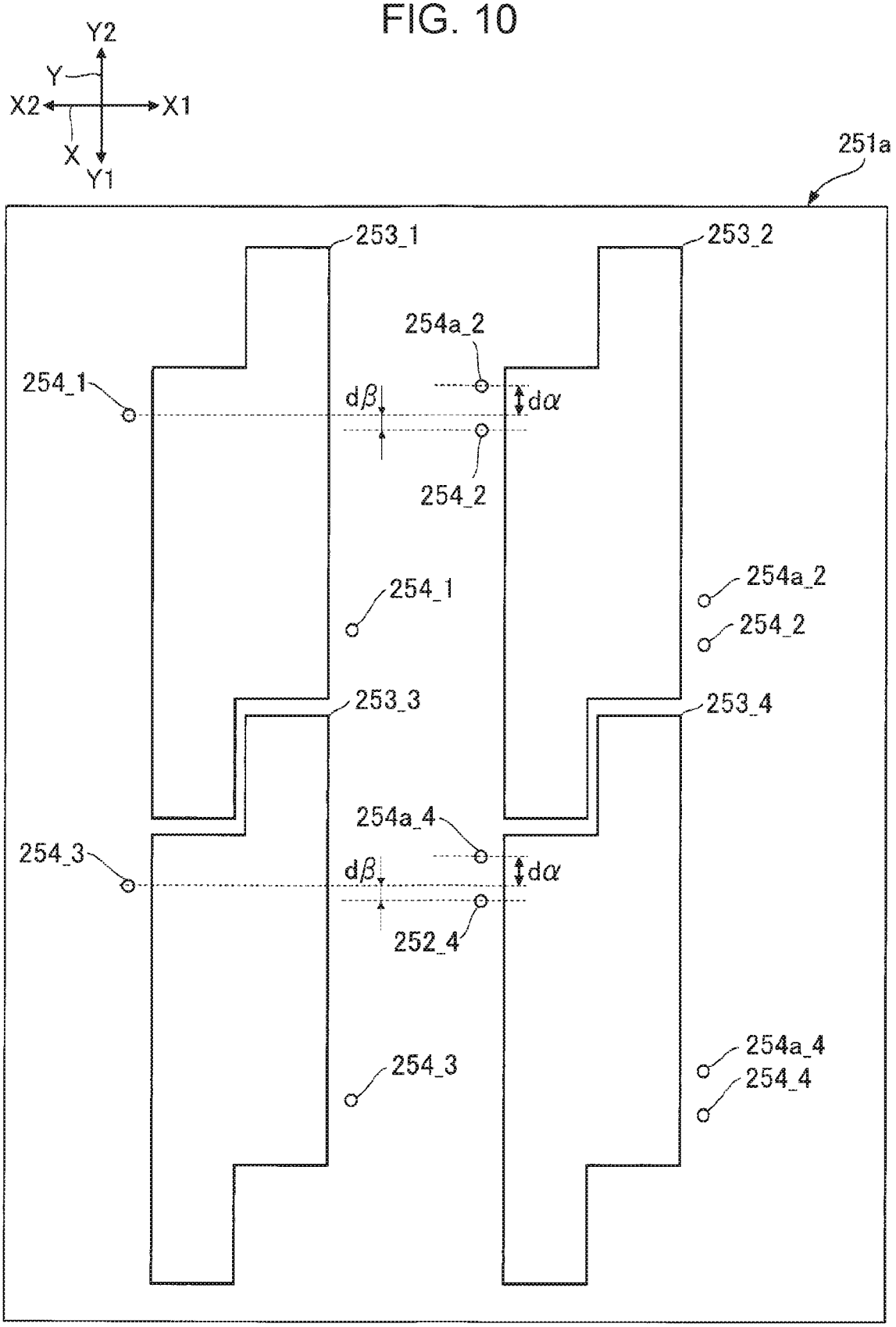
FIG. 10 is a plan view of a support body according to a second embodiment.

FIG. 10 is a plan view of a support body 251*a* according to the second embodiment. In the support body 251*a*, in addition to the plurality of mounting holes 253 and the plurality of screw holes 254, a plurality of screw holes 254*a*_2 for fixing the head unit 252_2 and a plurality of screw holes 254_4 for fixing the head unit 252_4 are formed. The screw hole 254*a*_2 is formed to be shifted with respect to the screw hole 254_1 by a distance dα. Similarly, the screw hole 254*a*_4 is formed to be shifted with respect to the screw hole 254_3 by a distance dα.

2-2. Disposition of Head Unit 252

Figure 11:
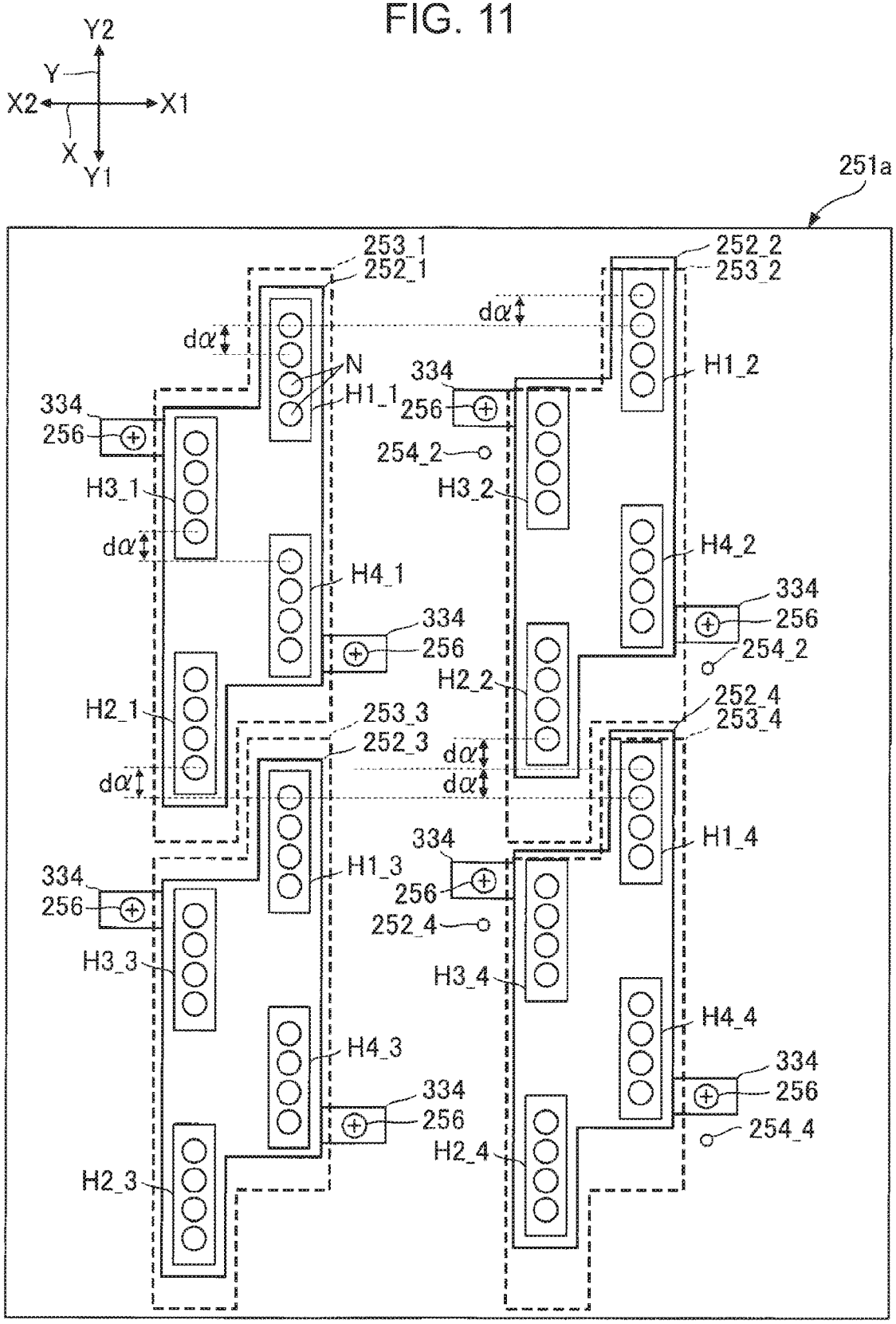
FIG. 11 is a diagram illustrating a state of the support body after fixing the head unit.

FIG. 11 is a diagram illustrating a state of the support body 251*a* after fixing the head unit 252. FIG. 11 illustrates an example in which the head unit 252_2 is fixed to the support body 251*a* by the screw hole 254*a*_2, and the head unit 252_4 is fixed to the support body 251*a* by the screw hole 254*a*_4.

In the Y1 direction or the Y2 direction, the screw hole 254_2 is formed to be shifted with respect to the screw hole 254_1 by a distance dα, and thus the head unit 252_2 is fixed to be shifted with respect to the head unit 252_1 by a distance dα. As a result, in the Y1 direction or the Y2 direction, the distance between the nozzle N provided in the head unit 252_1 and the nozzle N provided in the head unit 252_2 becomes the distance dα.

2-3. Effects of Second Embodiment

As understood from the above, in the liquid discharging apparatus 100, the support body 251 is further provided with a screw hole 254*a*_2 for fixing the head unit 252_2 on the support body 251, separately from the screw hole 254_2, and a distance between the screw hole 254_1 and the screw hole 254*a*_2 in the Y1 direction or the Y2 direction is a distance dα. The screw hole 254*a*_2 corresponds to "a fourth fixing portion".

A user of the liquid discharging apparatus 100 can select the high resolution by fixing the head unit 252_2 with the screw hole 254_2, or can select the low resolution by fixing the head unit 252_2 with the screw hole 254*a*_2. For example, a user who wants to print with the same color and high resolution can select the high resolution by fixing the head unit 252_2 with the screw holes 254_2. On the other hand, a user who wants to print using a plurality of colors of ink even at low resolution can select to print with the plurality of colors by fixing the head unit 252_2 with the screw hole 254*a*_2 and making the ink color of the head unit 252_1 different from the ink color of the head unit 252_2.

However, the distance between the screw hole 254_1 and the screw hole 254*a*_2 in the Y1 direction or the Y2 direction is not limited to the distance dα and may be n2×distance dα. n2 is an integer of 0 or more. When a value of n2 approaches 0, the length of the head module 25 in the Y1 direction or the Y2 direction can be shortened. However, since the size of the screw hole 254 is generally larger than the distance dβ, when the value of n2 approaches 0, there is a high possibility that the screw hole 254_2 and the screw hole 254*a*_2 overlap with each other. On the other hand, when the value of n2 becomes large, the possibility that the screw hole 254_2 and the screw hole 254*a*_2 overlap with each other becomes low. In other words, the larger the value of n2, the larger the screw hole 254_2 and the screw hole 254*a*_2 can be made. In the second embodiment, by setting n2 to 1, the possibility that the screw hole 254_2 and the screw hole 254*a*_2 overlap with each other is reduced as compared with the case where n2 is 0, and the length of the head module 25 in the Y1 direction or the Y2 direction is shortened as compared with the case where n2 is 2 or more.

Further, the screw hole 254_2 and the screw hole 254*a*_2 are provided at the same position in the X1 direction or the X2 direction. By having the screw hole 254_2 and the screw hole 254*a*_2 at the same position in the X1 direction or the X2 direction, the screw hole 254*a*_2 can be provided without changing the position of the drilling machine in the X1 direction or the X2 direction after providing the screw hole 254_2 by a laser oscillator or the drilling machine such as a drill at the time of manufacture, thereby the support body 251*a* can be easily manufactured.

3. Third Embodiment

In a second embodiment, in the Y1 direction or the Y2 direction, it is possible to select that the head unit 252_2 is disposed to be shifted with respect to the head unit 252_1 by the distance dβ or the head unit 252_2 is disposed to be shifted with respect to the head unit 252_1 by the distance dα, thereby the support body 251*a* is provided with the screw hole 254_2 and the screw hole 254*a*_2. On the other hand, a third embodiment is different from the second embodiment in that, as another configuration that achieves the same effect as that of the second embodiment, the head unit 252 is provided with a hole 335*b* separately from the hole 335. Hereinafter, the third embodiment will be described. In each embodiment and each modification example illustrated below, elements having the same operations and functions as those in the first embodiment are assigned the reference numerals used in the first embodiment, and the detailed description of each is appropriately omitted.

3-1. Head Unit 252*b* in Third Embodiment

Figure 12:
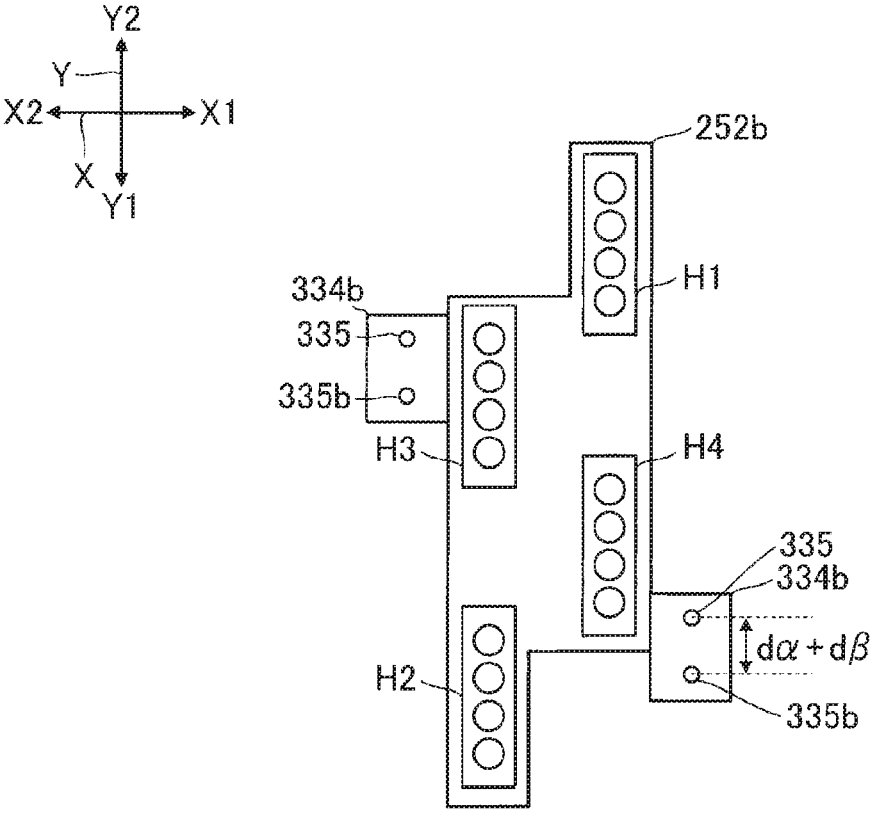
FIG. 12 is a plan view of a head unit according to a third embodiment.

FIG. 12 is a plan view of a head unit 252*b* according to the third embodiment. The holder 33 included in the head unit 252*b* is provided with a pair of flanges 334*b*. The flange 334 is provided with a hole 335 and a hole 335*b*. The hole 335 and the hole 335*b* are provided at a position separated by a distance dα+distance dβ in the Y1 direction or the Y2 direction, and are provided at the same position in the X1 direction or the X2 direction.

3-2. Disposition of Head Unit 252*b*

Figure 13:
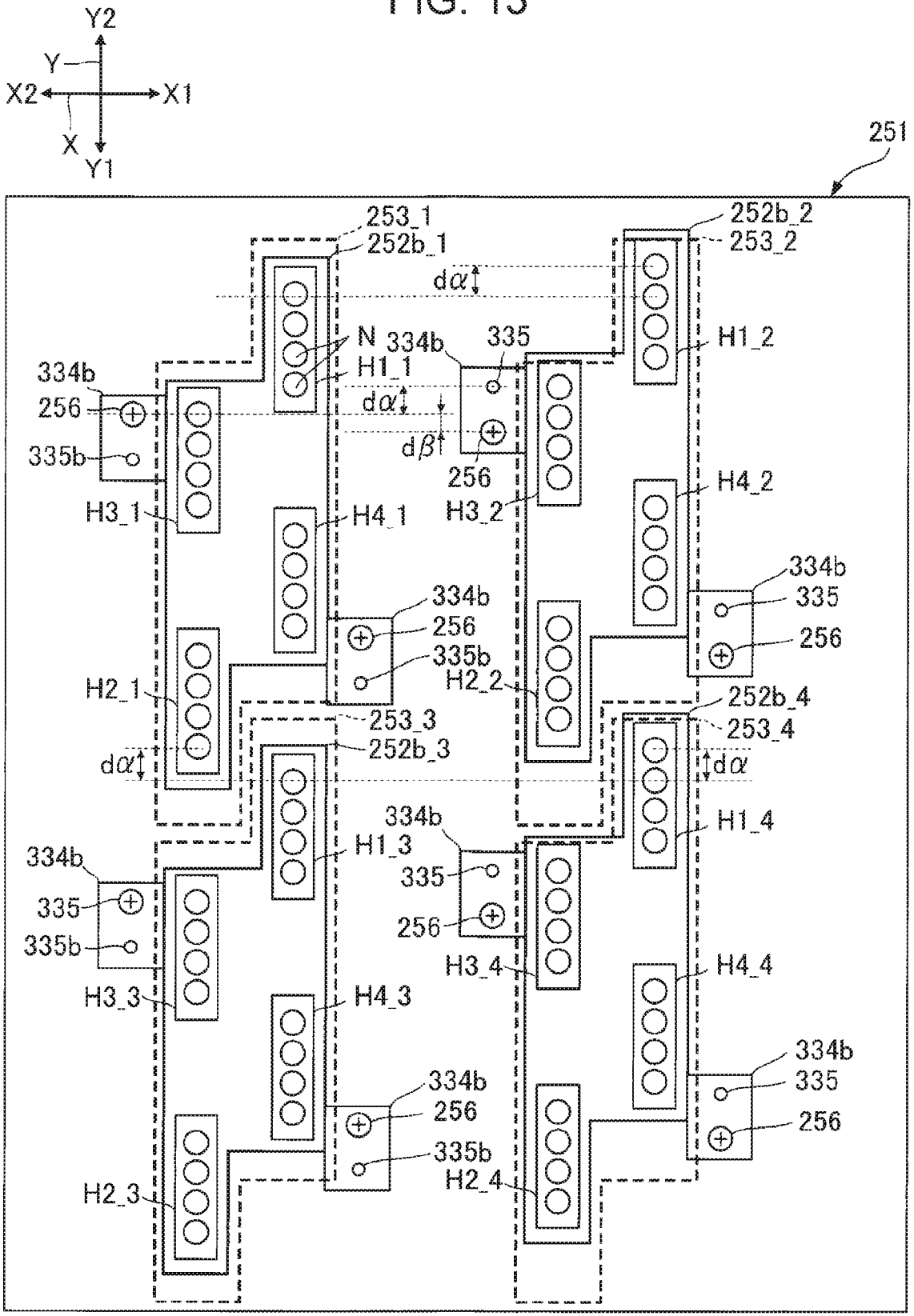
FIG. 13 is a diagram illustrating a state of the support body when the head units are disposed to be shifted by a distance.

FIG. 13 is a diagram illustrating a state of the support body 251 when the head units 252*b* are disposed to be shifted by a distance dα. FIG. 13 illustrates a state of the support body 251 when the head unit 252_2 is disposed to be shifted with respect to the head unit 252_1 by the distance dα. Since the head units 252*b* are disposed to be shifted by the distance dα, the head units 252*b*_1 and 252*b*_3 are fixed to the support body 251 by the holes 335, and the head units 252*b*_2 and 252*b*_4 are fixed to the support body 251 by the holes 335*b*.

The screw hole 254_2 is provided to be shifted from the screw hole 254_1 by the distance dβ in the Y1 direction, and the hole 335 is provided to be shifted from the hole 335*b* by the distance dα+distance dβ in the Y2 direction. Therefore, the distance dβ is canceled out and in the Y1 direction or the Y2 direction, the distance between the nozzle N provided in the head unit 252_1 and the nozzle N provided in the head unit 252_2 becomes the distance dα.

Figure 14:
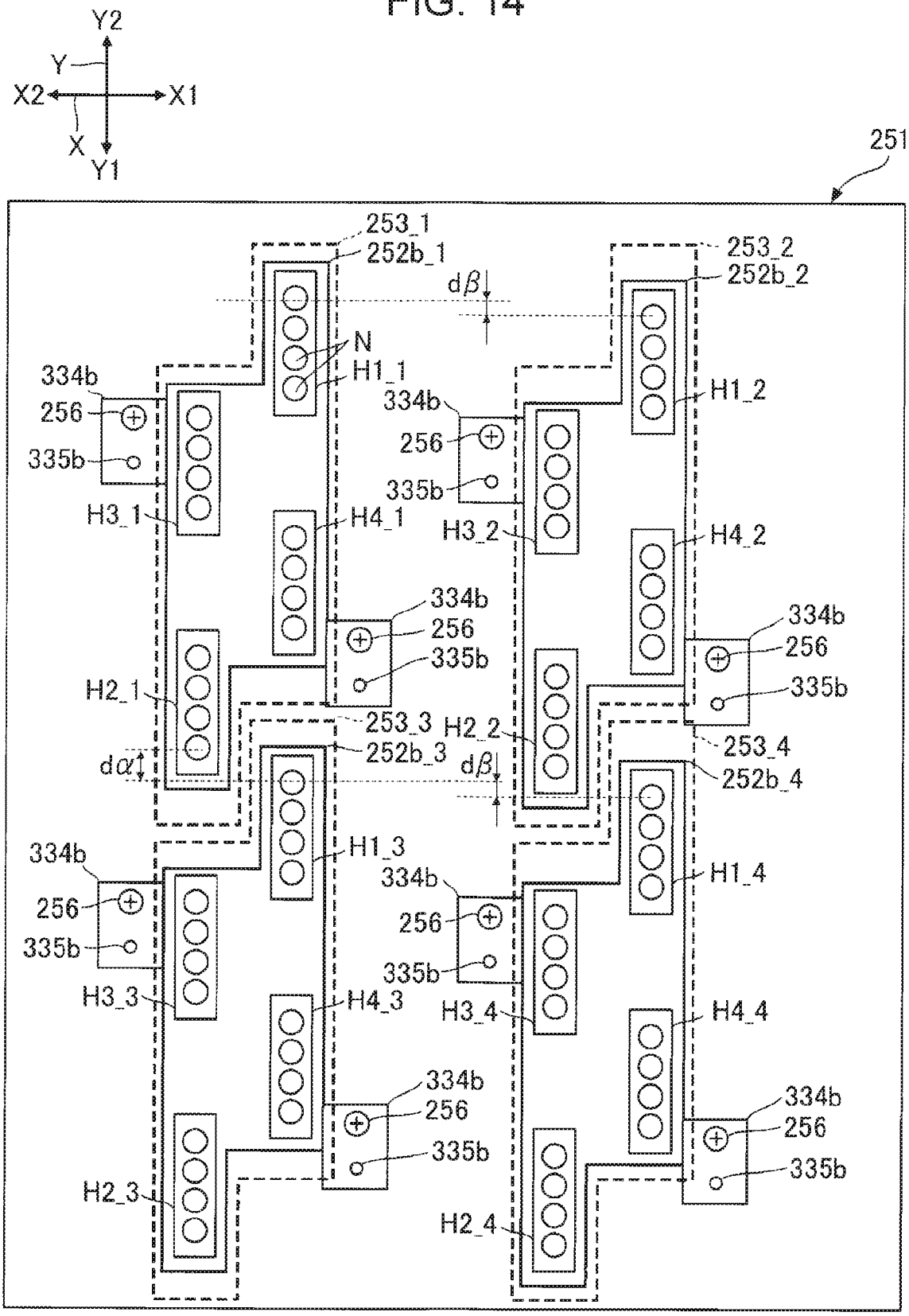
FIG. 14 is a diagram illustrating a state of the support body when the head units are disposed to be shifted by a distance.

FIG. 14 is a diagram illustrating a state of the support body 251 when the head units 252*b* are disposed to be shifted by a distance dβ. FIG. 14 illustrates a state of the support body 251 when the head unit 252_2 is disposed to be shifted with respect to the head unit 252_1 by the distance dβ. Since the head units 252*b* are disposed to be shifted by the distance dβ, the head units 252*b*_1, 252*b*_2, 252*b*_3, and 252*b*_4 are fixed to the support body 251 by the holes 335.

Since the screw hole 254_2 is provided to be shifted from the screw hole 254_1 by the distance dβ in the Y1 direction, in the Y1 direction or the Y2 direction, the distance between the nozzle N provided in the head unit 252_1 and the nozzle N provided in the head unit 252_2 becomes the distance dβ.

3-3. Effects of Third Embodiment

As can be understood from the above, the head unit 252_2 is provided with the hole 335*b* to be fixed to the screw hole 254_2 separately from the hole 335, and the distance between the hole 335 and the hole 335*b* in the Y1 direction or the Y2 direction is a distance obtained by adding the distance dβ to the distance dα. The hole 335*b* corresponds to "a third fixed portion".

Therefore, the user of the liquid discharging apparatus 100 can also select the high resolution by fixing the head units 252 using the holes 335, and select the low resolution by fixing the head units 252 using the holes 335*b*.

However, the distance between the hole 335 and the hole 335*b* in the Y1 direction or the Y2 direction is not limited to the distance obtained by adding the distance dβ to the distance dα, and may be n3×distance dα+distance dβ. n3 is an integer of 0 or more. When a value of n3 approaches 0, the size of the flange 334 can be reduced, and the weight reduction can be achieved. However, similar to the size of the screw hole 254 of the second embodiment, the size of the hole 335 is generally larger than the distance dβ, so that when the value of n3 approaches 0, there is a high possibility that the holes 335 and the holes 335*b* overlap with each other. On the other hand, when the value of n3 becomes large, the possibility that the hole 335 and the hole 335*b* overlap with each other becomes low. In the third embodiment, by setting n3 to 1, the possibility that the hole 335 and the hole 335*b* overlap with each other is reduced as compared with the case where n3 is 0, and the size of the flange 334 is reduced as compared with the case where n3 is 2 or more.

4. Fourth Embodiment

In the first embodiment, the Y axis position of the hole 335 (the first unit side fixing portion) in the head unit 252_1 and the Y axis position of the hole 335 (the second unit side fixing portion) in the head unit 252_2 are set to be the same, and by shifting the screw hole 254_1 and the screw hole 254_2 in the support body 251 by the distance dβ on the Y axis, the resolution is increased in the head unit 252_1 and the head unit 252_2.

On the other hand, in the present embodiment, the interval between the screw hole 254_1 and the screw hole 254_2 in the support body 251 is set to be q (q is an integer of zero or more) times dα on the Y axis. For example, the Y axis positions of the screw hole 254_1 and the screw hole 254_2 are substantially coincide with each other. On the other hand, the Y axis position of the hole 335 in the head unit 252_1 and the Y axis position of the hole 335 in the head unit 252_2 are shifted from each other by the distance dβ. Thereby, also in the present embodiment, the resolution can be increased in the head unit 252_1 and the head unit 252_2.

However, in the case of this embodiment, since the Y axis positions of the holes 335 of the head unit 252_1 and the head unit 252_2 are different, some parts of these two head units 252 must be manufactured in separate processing. Therefore, the manufacturing cost increases.

On the other hand, in the first embodiment, the manufacturing cost can be reduced because the manufacturing can be performed only by providing the screw holes 254_1 and the screw holes 254_2 of the support body 251 at different positions on the Y axis.

5. Modification Example

The form illustrated above may be variously modified. A specific aspect of modification that can be applied to the above-described embodiments is illustrated below. Any two or more aspects selected from the following examples can be appropriately combined within a range not inconsistent with each other.

1. In the above-described embodiment, the pair of flanges 334 are provided on the end surface of the first part U1 in the X1 direction and the end surface of the first part U1 in the X2 direction, respectively, but the positions of the pair of flanges 334 are not limited to the positions illustrated in FIG. 4.

Figure 15:
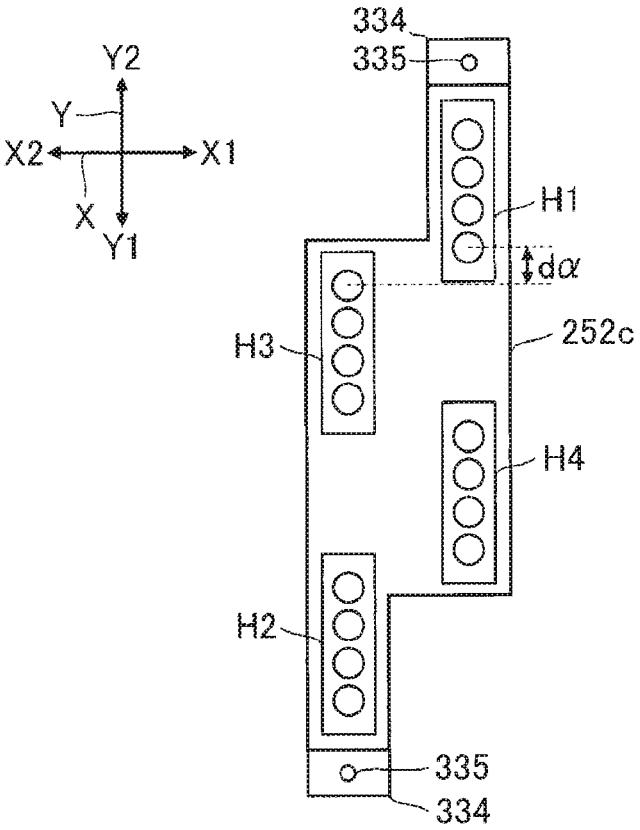
FIG. 15 is a plan view of a head unit according to a modification example.

FIG. 15 is a plan view of a head unit 252*c* according to a modification example. In the head unit 252*c*, the pair of flanges 334 are provided on the end surface of the second part U2 in the Y2 direction and the end surface of the third part U3 in the Y1 direction, respectively.

2. In the above-described embodiment, the number of circulation heads Hn included in one head unit 252 is four, but the number of circulation heads Hn included in one head unit 252 may be three or less or five or more.

Figure 16:
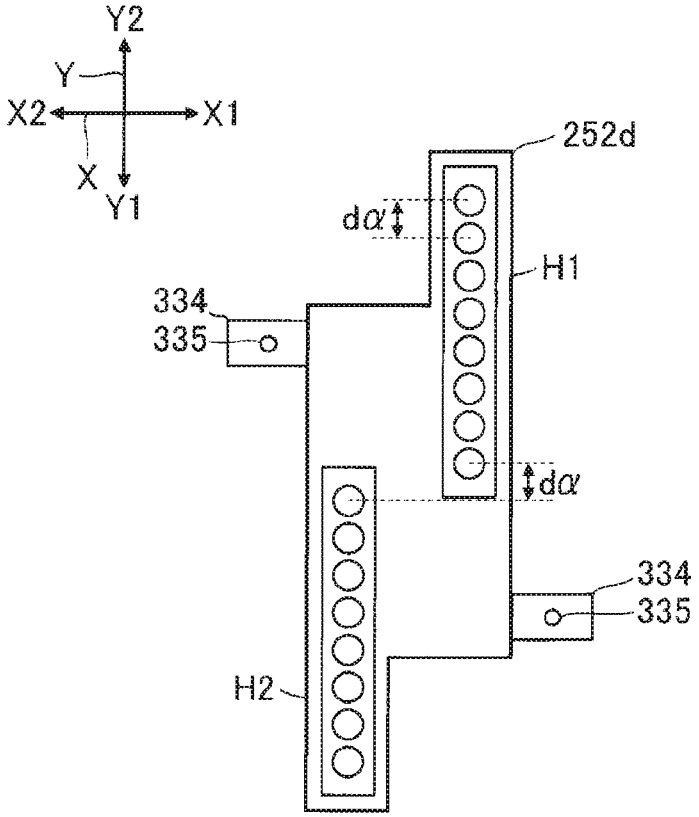
FIG. 16 is a plan view of a head unit according to the modification example.

FIG. 16 is a plan view of a head unit 252*d* according to the modification example. The head unit 252*d* includes two circulation heads H1 and H2.

3. In the above-described embodiment, the plurality of head units 252 supported by the support body 251 have the same configuration, but the configuration of the head unit 252 corresponding to the first head unit and the configuration of the head unit 252 corresponding to the second head unit may be different from each other.

4. In the above-described embodiment, the sub tank 13 is provided outside the head unit 252, and the ink is circulated between the head unit 252 and the sub tank 13, but instead of the sub tank, any system may be used as long as the system circulates ink between the head unit 252 and the outside of the head unit 252. For example, the ink may be circulated between the head unit 252 and the liquid container 12.

5. In the above-described embodiment, the serial type liquid discharging apparatus in which the transporting body 241 having the head unit 252 mounted thereon is reciprocated has been exemplified, but the present disclosure can be applied to a line type liquid discharging apparatus in which a plurality of nozzles N are distributed over the entire width of the medium 11.

6. The liquid discharging apparatus exemplified in the above-described embodiment can be adopted not only in an apparatus dedicated to printing but also in various apparatus such as a facsimile apparatus and a copying machine. Moreover, the application of the liquid discharging apparatus is not limited to printing. For example, a liquid discharging apparatus that discharges a solution of a coloring material is utilized as a manufacturing apparatus that forms a color filter of a display apparatus such as a liquid crystal display panel. Further, a liquid discharging apparatus that discharges a solution of a conductive material is utilized as a manufacturing apparatus that forms wiring or electrodes of a wiring substrate. Further, a liquid discharging apparatus that discharges a solution of an organic substance related to a living body is utilized, for example, as a manufacturing apparatus that manufactures a biochip.

7. The circulation head Hn illustrated in the above-described embodiment is formed by laminating a plurality of substrates, which are not shown in the figure, but the above-mentioned each component of the circulation head Hn is appropriately provided. For example, the first nozzle row La and the second nozzle row Lb are provided on a nozzle substrate. The first liquid storage chamber Ra and the second liquid storage chamber Rb are provided on a reservoir substrate. The plurality of first pressure chambers Ca and the plurality of second pressure chambers Cb are provided on a pressure chamber substrate. The plurality of first driving elements Ea and the plurality of second driving elements Eb are provided on an element substrate. One or more of the above nozzle substrate, reservoir substrate, pressure chamber substrate, and element substrate are individually provided for each circulation head Hn. For example, when the nozzle substrate is provided individually for each circulation head Hn, one or more of the reservoir substrate, the pressure chamber substrate, and the element substrate may be commonly provided for the plurality of circulation heads Hn in the head unit 252. Further, when the reservoir substrate and the pressure chamber substrate are individually provided for each circulation head Hn, the nozzle substrate or the like may be provided commonly for the plurality of circulation heads Hn in the head unit 252. Furthermore, the driving circuits for driving the plurality of first driving elements Ea and the plurality of second driving elements Eb may be provided individually for each circulation head Hn, or may be provided commonly for the plurality of circulation heads Hn in the head unit 252.

8. In the above-described embodiment, the head unit 252 having the first part U1, the second part U2, and the third part U3 as illustrated in FIGS. 3, 4, 5, and the like has been described, but it does not have to be a head unit of such an embodiment. For example, the external appearance of the head unit may be a rectangular parallelepiped shape. The present disclosure can be applied to any shape of external appearance as long as it is a system having a support body for supporting a plurality of head units.

What is claimed is:

1. A liquid discharging apparatus comprising:

a first head unit provided with a plurality of first nozzles that discharge a liquid;

a second head unit provided with a plurality of second nozzles that discharge the liquid; and a support body supporting the first head unit and the second head unit, wherein the plurality of first nozzles and the plurality of second nozzles are arranged such that a distance between nozzles adjacent to each other in a first direction is a first distance, the support body is provided with a first fixing portion, which is a screw hole, for fixing the first head unit onto the support body and a second fixing portion, which is a screw hole, for fixing the second head unit onto the support body, a distance between the first fixing portion and the second fixing portion in the first direction is a second distance that is different from an integral multiple of the first distance;

a third head unit provided with a plurality of third nozzles that discharge the liquid, wherein the support body is further provided with a third fixing portion for fixing the third head unit onto the support body, the first head unit and the third head unit are provided on the support body at different positions in the first direction and at the same position in the second direction, and a distance between the first fixing portion and the third fixing portion in the first direction is an integral multiple of the first distance.

2. The liquid discharging apparatus according to claim 1, wherein the second distance is shorter than the first distance.

3. The liquid discharging apparatus according to claim 1, wherein the first head unit and the second head unit are provided at different positions on the support body in a second direction intersecting the first direction, and a distance between the first fixing portion and the second fixing portion in the second direction is a third distance that is longer than each of the first distance and the second distance.

4. The liquid discharging apparatus according to claim 1, wherein the first head unit further includes a first head in which a part or all of the plurality of first nozzles are arranged, and a first holder in which the first head is disposed, the second head unit further includes a second head in which a part or all of the plurality of second nozzles are arranged, and a second holder in which the second head is disposed, the first holder is provided with a first fixed portion to be fixed to the first fixing portion, and the second holder is provided with a second fixed portion to be fixed to the second fixing portion.

5. The liquid discharging apparatus according to claim 4, wherein each of the first fixed portion and the second fixed portion is a hole portion.

6. The liquid discharging apparatus according to claim 4, wherein the support body is provided with a first opening portion corresponding to the first head when the first head unit is fixed and a second opening portion corresponding to the second head when the second head unit is fixed, and the first opening portion and the second opening portion are provided at the same position in the first direction.

7. The liquid discharging apparatus according to claim 6, wherein the support body is provided with a plurality of the first fixing portions and a plurality of the second fixing portions, the plurality of the first fixing portions are provided such that the first opening portion is interposed between the plurality of the first fixing portions, and the plurality of the second fixing portions are provided such that the second opening portion is interposed between the plurality of the second fixing portions.

8. The liquid discharging apparatus according to claim 1, wherein the support body is further provided with a fourth fixing portion for fixing the second head unit onto the support body separately from the second fixing portion, and a distance between the first fixing portion and the fourth fixing portion in the first direction is an integral multiple of the first distance.

9. The liquid discharging apparatus according to claim 8, wherein the second fixing portion and the fourth fixing portion are provided at the same position in a second direction intersecting the first direction.

10. The liquid discharging apparatus according to claim 4, wherein the second head unit is provided with a third fixed portion to be fixed to the second fixing portion separately from the second fixed portion, and a distance between the second fixed portion and the third fixed portion in the first direction is a distance obtained by adding the second distance to an integral multiple of the first distance.

11. The liquid discharging apparatus according to claim 1, wherein the first head unit is provided with a first unit side fixing portion for fixing the first head unit to the support body, the second head unit is provided with a second unit side fixing portion for fixing the second head unit to the support body, and a distance between the first unit side fixing portion and the second unit side fixing portion in the first direction is an integral multiple of the first distance.

12. A liquid discharging apparatus comprising:

a first head unit provided with a plurality of first nozzles that discharge a liquid;

a second head unit provided with a plurality of second nozzles that discharge the liquid; and a support body supporting the first head unit and the second head unit, wherein the plurality of first nozzles and the plurality of second nozzles are arranged such that a distance between nozzles adjacent to each other in a first direction is a first distance, the support body is provided with a first fixing portion, which is a screw hole, for fixing the first head unit onto the support body and a second fixing portion, which is a screw hole, for fixing the second head unit onto the support body, a distance between the first fixing portion and the second fixing portion that is screw hole in the first direction is a second distance that is shorter than the first distance;

a third head unit provided with a plurality of third nozzles that discharge the liquid, wherein the support body is further provided with a third fixing portion for fixing the third head unit onto the support body, the first head unit and the third head unit are provided on the support body at different positions in the first direction and at the same position in the second direction, and a distance between the first fixing portion and the third fixing portion in the first direction is an integral multiple of the first distance.

13. A liquid discharging apparatus comprising:

a first head unit provided with a plurality of first nozzles that discharge a liquid;

a second head unit provided with a plurality of second nozzles that discharge the liquid; and a support body supporting the first head unit and the second head unit, wherein the plurality of first nozzles and the plurality of second nozzles are arranged such that a distance between nozzles adjacent to each other in a first direction is a first distance, the first head unit is provided with a first unit side fixing portion, which is a screw hole, for fixing the first head unit to the support body, the second head unit is provided with a second unit side fixing portion, which is a screw hole, for fixing the second head unit to the support body, a distance between the first unit side fixing portion and the second unit side fixing portion in the first direction is a second distance that is different from an integral multiple of the first distance;

a third head unit provided with a plurality of third nozzles that discharge the liquid, wherein the support body is further provided with a third unit side fixing portion for fixing the third head unit onto the support body, the first head unit and the third head unit are provided on the support body at different positions in the first direction and at the same position in the second direction, and a distance between the first unit side fixing portion and the third unit side fixing portion in the first direction is an integral multiple of the first distance.

14. The liquid discharging apparatus according to claim 13, wherein the support body is provided with a first fixing portion for fixing the first head unit onto the support body and a second fixing portion for fixing the second head unit onto the support body, and a distance between the first fixing portion and the second fixing portion in the first direction is an integral multiple of the first distance.

15. A support body for supporting a first head unit provided with a plurality of first nozzles that discharge a liquid and a second head unit provided with a plurality of second nozzles that discharge the liquid, comprising:

a first fixing portion, which is a screw hole, for fixing the first head unit onto the support body; and a second fixing portion, which is a screw hole, for fixing the second head unit onto the support body, wherein a distance between the first fixing portion and the second fixing portion in a first direction is different from an integral multiple of a distance between nozzles adjacent to each other of the plurality of first nozzles and the plurality of second nozzles in the first direction;

a third head unit provided with a plurality of third nozzles that discharge the liquid, wherein the support body is further provided with a third fixing portion for fixing the third head unit onto the support body, the first head unit and the third head unit are provided on the support body at different positions in the first direction and at the same position in the second direction, and a distance between the first fixing portion and the third fixing portion in the first direction is an integral multiple of the first distance.

16. The support body according to claim 15, wherein the distance between the first fixing portion and the second fixing portion in the first direction is shorter than the distance between the nozzles adjacent to each other of the plurality of first nozzles and the plurality of second nozzles in the first direction.

17. A liquid discharging apparatus according to claim 1, wherein the support body is further provided with a first mounting hole in which the first head is inserted, and the first fixing portion is disposed on a side of the first mounting hole in a second direction intersecting the first direction.

18. A liquid discharging apparatus according to claim 12, wherein the support body is further provided with a first mounting hole in which the first head is inserted, and the first fixing portion is disposed on a side of the first mounting hole in a second direction intersecting the first direction.

19. A liquid discharging apparatus according to claim 13, wherein the support body is further provided with a first mounting hole in which the first head is inserted, and the first unit side fixing portion is disposed on a side of the first mounting hole in a second direction intersecting the first direction.

* * * * *